US009675218B2

(12) United States Patent
Kim et al.

(10) Patent No.: US 9,675,218 B2
(45) Date of Patent: Jun. 13, 2017

(54) SUPPORTER AND VACUUM CLEANER HAVING THE SAME

(71) Applicant: SAMSUNG ELECTRONICS CO., LTD., Suwon-si, Gyeonggi-do (KR)

(72) Inventors: Byeong-soo Kim, Hanam-si (KR); Soo-hyun Yoon, Hanam-si (KR); Kyoung-min Lee, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 340 days.

(21) Appl. No.: 14/595,609

(22) Filed: Jan. 13, 2015

(65) Prior Publication Data

US 2016/0058253 A1 Mar. 3, 2016

(30) Foreign Application Priority Data

Aug. 27, 2014 (KR) ..... 10-2014-0112212

(51) Int. Cl.

| | |
|---|---|
| ***A47L 5/22*** | (2006.01) |
| ***A47L 9/00*** | (2006.01) |
| ***A47L 5/24*** | (2006.01) |
| ***A47L 5/28*** | (2006.01) |
| ***A47L 5/36*** | (2006.01) |
| ***A47L 9/24*** | (2006.01) |

(52) U.S. Cl.

CPC ..... *A47L 5/225* (2013.01); *A47L 5/24* (2013.01); *A47L 5/28* (2013.01); *A47L 5/36* (2013.01); *A47L 9/009* (2013.01); *A47L 9/0027* (2013.01); *A47L 9/0054* (2013.01); *A47L 9/248* (2013.01)

(58) Field of Classification Search

CPC ... A47L 5/225; A47L 5/24; A47L 5/28; A47L 5/36; A47L 9/0027; A47L 9/0054; A47L 9/009; A47L 9/248

See application file for complete search history.

(56) References Cited

U.S. PATENT DOCUMENTS

| | | | | |
|---|---|---|---|---|
| 5,247,719 | A | 9/1993 | Wareham et al. | |
| 6,317,920 | B1 | 11/2001 | Brickner et al. | |
| 7,140,068 | B1 * | 11/2006 | Vander Baan | A47L 5/28 15/347 |

(Continued)

FOREIGN PATENT DOCUMENTS

| | | |
|---|---|---|
| EP | 0316528 A2 | 5/1989 |
| EP | 0898922 A1 | 3/1999 |

OTHER PUBLICATIONS

Extended European Search Report dated Jan. 28, 2016 in corresponding European Patent Application No. 15181269.0.

*Primary Examiner* — Dung Van Nguyen

(74) *Attorney, Agent, or Firm* — Staas & Halsey LLP

(57) ABSTRACT

A supporter and a vacuum cleaner having the same are provided. The supporter includes: a suction channel portion that includes one end removably connected with a vacuum cleaning unit and the other end connected with a suction nozzle, thereby guiding dirt drawn in through the suction nozzle to the vacuum cleaning unit; an accessory that is received in a receiving recess formed on one side of the suction channel portion; a hinge portion that is disposed in the suction channel portion and supports the accessory to pivot by a predetermined angle; and an unlocking portion that is disposed in the suction channel portion to lock and unlock the accessory with respect to the receiving recess.

20 Claims, 41 Drawing Sheets

(56) References Cited

U.S. PATENT DOCUMENTS

| | | | | |
|---|---|---|---|---|
| 8,166,607 | B2 * | 5/2012 | Conrad | A47L 5/225 15/331 |
| 8,713,751 | B2 * | 5/2014 | Conrad | A47L 9/125 134/21 |
| 2004/0134022 | A1 * | 7/2004 | Murphy | A47L 5/28 15/353 |
| 2005/0125937 | A1 * | 6/2005 | Nielsen | A47L 5/22 15/326 |
| 2006/0230715 | A1 * | 10/2006 | Oh | A47L 9/1658 55/337 |
| 2015/0135474 | A1 * | 5/2015 | Gidwell | A47L 5/225 15/323 |

* cited by examiner

SUPPORTER AND VACUUM CLEANER HAVING THE SAME

CROSS-REFERENCE TO RELATED APPLICATIONS

This application claims the priority benefit under 35 U.S.C. §119(a) of Korean Patent Application No. 10-2014-0112212, filed on Aug. 27, 2014, in the Korean Intellectual Property Office, the entire disclosure of which is hereby incorporated by reference.

BACKGROUND

1. Field

Apparatuses and methods consistent with exemplary embodiments relate to a supporter and a vacuum cleaner having the same, and more particularly, to a supporter where an accessory can be easily mounted or dismounted so as to be converted from a wide area cleaning mode to a narrow area cleaning mode or vice versa with ease, and a vacuum cleaner having the same.

2. Description of the Related Art

In general, vacuum cleaners are home appliances that are configured to draw in dirt or contaminants from floors, walls, or cracks by using a powerful suction force generated by a negative pressure accompanied with an operation of a vacuum pump. The vacuum cleaners are divided into a canister type, an upright type, a handy type, and a stick type.

In particular, a related-art stick type vacuum cleaner includes a vacuum cleaning unit or device, a supporter connected to a suction port of the vacuum cleaning unit and serving an extension pipe, and a suction nozzle connected to a lower end of the supporter. In this case, the vacuum cleaning unit may be a handy type vacuum cleaner which is removably connected with the supporter.

In the case of such a related-art stick type vacuum cleaner, the vacuum cleaning unit can be separated from the supporter for use. Further, an extra accessory can be connected to the suction port of the vacuum cleaning unit to clean a stair, a crack or a ceiling.

However, in the case of the related-art stick type vacuum cleaner, the accessory is removably mounted on the suction nozzle. Therefore, there is inconvenience that the user should bend his/her back to dismount the accessory from the suction nozzle to use the accessory or to mount the accessory on the suction nozzle after use.

In this case, the user should hold the accessory with his/her hand to connect it to the vacuum cleaning unit. Thus, there is a problem that the user's hand may get dirty.

In addition, when the stick type vacuum cleaner is not equipped with an extra accessory, the user may have inconvenience of having to find an accessory from a charger (a device for charging a stick type vacuum cleaner) keeping the accessory or a separate accessory storage box.

SUMMARY

Additional aspects and/or advantages will be set forth in part in the description which follows and, in part, will be apparent from the description, or may be learned by practice of the invention.

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide a supporter which enables a user to mount an accessory on a vacuum cleaning unit easily and rapidly without bending his/her back, and a vacuum cleaner having the same.

According to an aspect of an exemplary embodiment, there is provided a supporter including: a suction channel portion that includes one end removably connected with a vacuum cleaning unit and the other end connected with a suction nozzle, thereby guiding dirt drawn in through the suction nozzle to the vacuum cleaning unit; an accessory that is received in a receiving recess formed on one side of the suction channel portion; a hinge portion that is disposed in the suction channel portion and supports the accessory to pivot by a predetermined angle; and an unlocking portion that is disposed in the suction channel portion to lock and unlock the accessory with respect to the receiving recess.

The hinge portion may be disposed in the receiving recess, and may include one end connected with the suction channel portion by a hinge and the other end removably inserted into a lower end of the accessory.

The unlocking portion may include: an operating button a part of which is exposed to an outside of the suction channel portion; and an elastic member configured to elastically support the operating button.

The operating button may include a connection protrusion removably connected with an upper end of the accessory, and the accessory includes an insertion recess formed on a location to correspond to the connection protrusion when the accessory is inserted into the receiving recess.

A center of gravity of the accessory may be located at an upper end portion.

Further, the center of gravity of the accessory may be located at an eccentric location in a direction in which the accessory is separated from the receiving recess.

The accessory may be received in the receiving recess slantly in a direction of being separated from the receiving recess.

The hinge portion may be elastically disposed in the suction channel portion in a direction of pivoting to an outside of the receiving recess.

The hinge portion may be installed in the suction channel portion by a torsion spring.

The supporter may further include: a first magnet which is disposed in the suction channel portion; and a second magnet which is disposed in the accessory and has a same polarity as that of the first magnet, and the first and second magnets may be disposed at locations facing each other when the accessory is inserted into the receiving recess.

The unlocking portion may include: an operating rod which interworks with the operating button; a third magnet which is disposed in the suction channel portion; and a fourth magnet which is disposed in the accessory and has a polarity opposite to that of the third magnet, and the operating rod may include a connection protrusion formed at one end thereof to be removably connected with the upper end of the accessory.

The operating rod may include the other end connected with the suction channel portion by a hinge.

The unlocking portion may make the hinge portion pivot to the outside of the receiving recess in response to the vacuum cleaning unit being separated from the suction channel portion.

The unlocking portion may include: a moving member which is inserted into the suction channel portion to ascend and descend in a lengthwise direction of the suction channel portion; and an elastic member which elastically supports the moving member in an ascending direction, and the moving member may be pressed by self-weight of the vacuum cleaning unit and may be kept in a descending state, and, in response to the vacuum cleaning unit being separated from the suction channel portion, the moving member may ascend by the elastic member.

The hinge portion may make the accessory be drawn out from the receiving recess or received in the receiving recess by interworking with the ascending or descending movement of the moving member.

The hinge portion may include a locking protrusion, and the moving member may include first and second push protrusion formed at locations corresponding to the hinge portion. The first and second push protrusions may be formed at intervals in a lengthwise direction along the moving member, and may push the locking protrusion of the hinge portion according to an ascending or descending movement of the moving member and may pivot the hinge portion in one direction or in a reverse direction.

The moving member may include a locking protrusion for locking and unlocking the upper end of the accessory.

The accessory may be received in the receiving recess slantly in a direction of being separated from the receiving recess.

A center of gravity of the accessory may be located at an upper end portion.

The center of gravity of the accessory may be located at an eccentric location in a direction in which the accessory is separated from the receiving recess.

The supporter may further include: a first magnet which is disposed in the suction channel portion; and a second magnet which is disposed in the accessory and has a same polarity as that of the first magnet, and the first and second magnet may be placed on locations facing each other when the accessory is inserted into the receiving recess.

The hinge portion may be elastically disposed in the suction channel portion in a direction of pivoting to the outside of the receiving recess.

The hinge portion may be installed in the suction channel portion by a torsion spring.

The receiving recess may include a restriction projection extending from a lower end thereof to restrict a rotation angle of the accessory.

According to an aspect of another exemplary embodiment, there is provided a vacuum cleaner including: a suction nozzle; a cleaner body having a lower end fluidly connected with the suction nozzle by a hinge; and a supporter fluidly connected with the suction nozzle and supporting the cleaner body. The supporter may include a suction channel portion which includes one end removably connected with a vacuum cleaning unit and the other end connected with a suction nozzle, thereby guiding dirt drawn in through the suction nozzle to the vacuum cleaning unit; an accessory which is received in a receiving recess formed on one side of the suction channel portion; a hinge portion which is disposed in the receiving recess, and includes one end connected with the suction channel portion by a hinge and the other end removably inserted into a lower end of the accessory, thereby pivoting the accessory by a predetermined angle; and an unlocking portion which is disposed in the suction channel portion to lock and unlock the accessory with respect to the receiving recess.

According to an aspect of another exemplary embodiment, there is provided a vacuum cleaner including: a suction nozzle; a supporter fluidly connected with the suction nozzle, and a cleaner body fluidly connected with the supporter. The supporter may include a suction channel portion which includes one end removably connected with a vacuum cleaning unit and the other end connected with a suction nozzle, thereby guiding dirt drawn in through the suction nozzle to the vacuum cleaning unit; an accessory which is received in a receiving recess formed on one side of the suction channel portion; a hinge portion which is disposed in the receiving recess, and includes one end connected with the suction channel portion by a hinge and the other end removably inserted into a lower end of the accessory, thereby pivoting the accessory by a predetermined angle; and an unlocking portion which is disposed in the suction channel portion to lock and unlock the accessory with respect to the receiving recess.

BRIEF DESCRIPTION OF THE DRAWINGS

The above and/or other aspects will be more apparent by describing in detail exemplary embodiments, with reference to the accompanying drawings, in which.

DETAILED DESCRIPTION

Figure 1A:
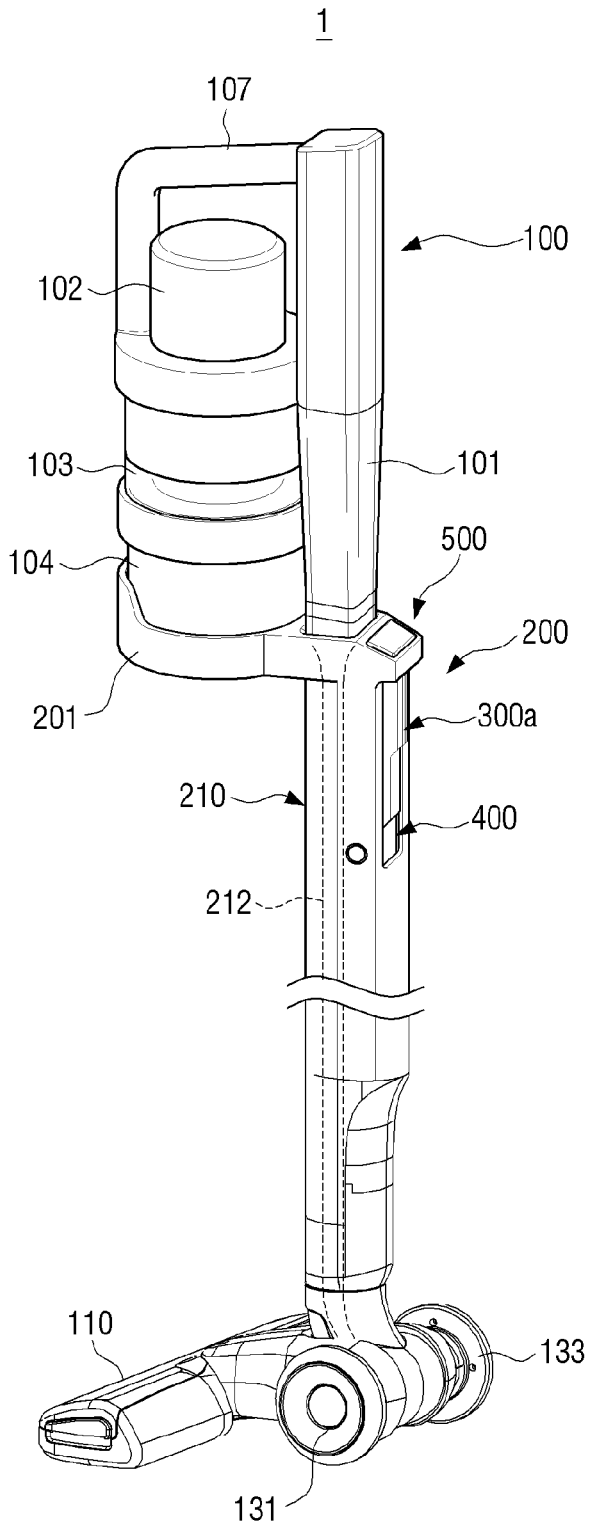
FIG. 1A is a perspective view illustrating a stick type vacuum cleaner according to an exemplary embodiment.

Reference will now be made in detail to the embodiments, examples of which are illustrated in the accompanying drawings, wherein like reference numerals refer to the like elements throughout. The embodiments are described below to explain the present invention by referring to the figures.

Hereinafter, exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of exemplary embodiments. Thus, it is apparent that exemplary embodiments can be carried out without those specifically defined matters. Also, functions or elements known in the related art are not described in detail since they would obscure the exemplary embodiments with unnecessary detail.

Hereinafter, a supporter with an accessory is removably connected and a vacuum cleaner having the same according to exemplary embodiments will be explained in detail with reference to the accompanying drawings.

A stick type vacuum cleaner 1 according to an exemplary embodiment will be explained with reference to FIGS. 1A to 2B.

Referring to FIG. 1A, the stick type vacuum cleaner 1 includes a vacuum cleaning unit 100, a suction nozzle 110, and a supporter 200.

The vacuum cleaning unit 100 is removably connected with an upper portion of the supporter 200, and may be used along with the supporter 200 or may be separated from the supporter 200 and used independently.

That is, when the vacuum cleaning unit 100 is connected with the supporter 200 and used along with the supporter 200, the vacuum cleaning unit 100 collects dirt which is drawn in the supporter 200 from a surface through the suction nozzle 110 through a suction pipe 101 formed on one side of the vacuum cleaning unit 100. In addition, when the vacuum cleaning unit 100 is separated from the supporter 200, the vacuum cleaning unit 100 directly draws in dirt through the suction pipe 101 like a handy type cleaner or may clean a crack or a higher place such as a ceiling by using an accessory 300*a* connected therewith as shown in FIG. 10.

In addition, the vacuum cleaning unit 100 may include a suction motor 102, a cyclone portion 103 for separating dirt and air by using a centrifugal force, a dust receptacle 104 for collecting dirt separated from air in the cyclone portion 103, and a handle 107.

The suction nozzle 110 is fluidly connected with a lower end of the supporter 200 by means of a hinge, and draws in dirt by a negative pressure which is formed between a cleaning surface and a bottom surface of the suction nozzle 110 by a suction force generated by the vacuum cleaning unit 100 and guides the dirt to the supporter 200.

In this case, a pair of wheels 131 and 133 are rotatably connected with lower opposite ends of the supporter 200 at the rear of the suction nozzle 110 to travel along the cleaning surface.

Figure 1B:
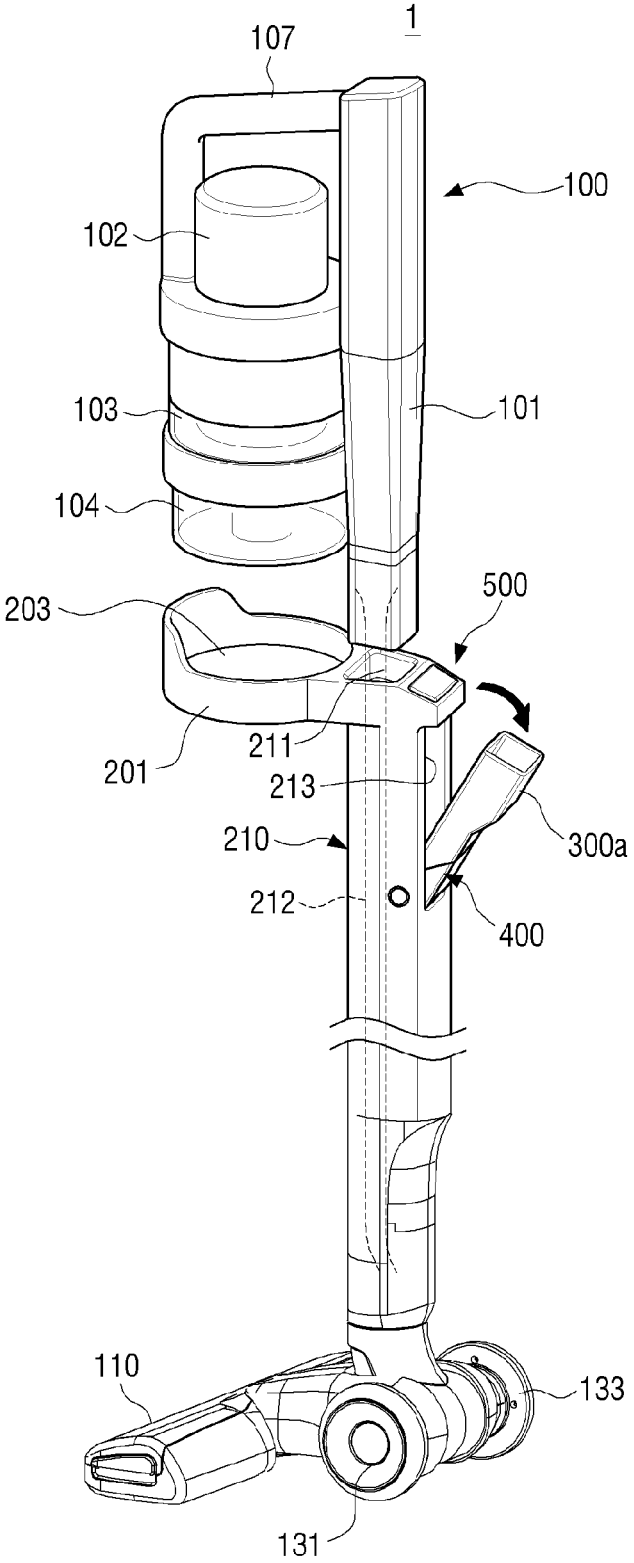
FIG. 1B is a perspective view illustrating an accessory being drawn out from the supporter shown in FIG. 1A.
Figure 1C:
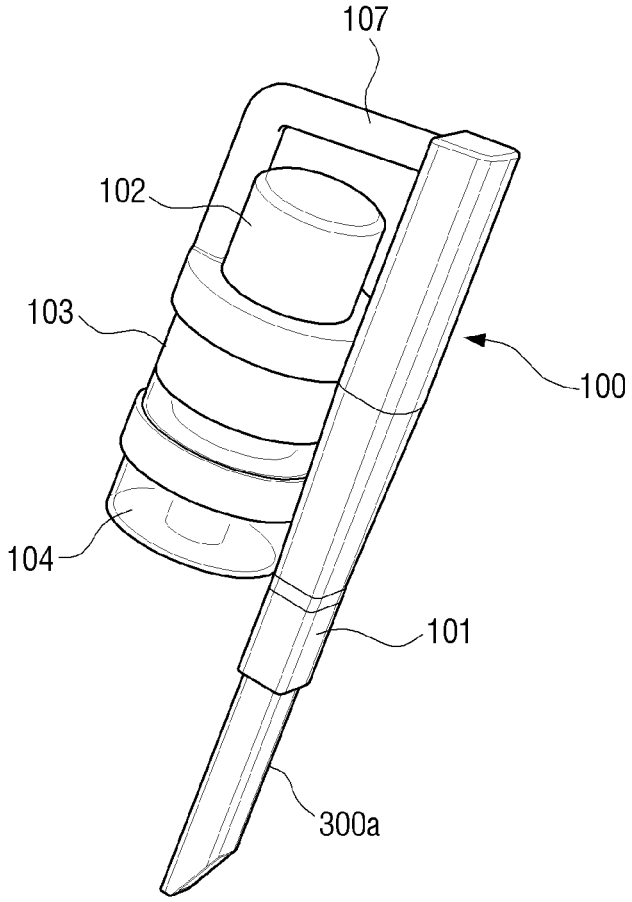
FIG. 1C is a perspective view illustrating the accessory being mounted in the vacuum cleaning unit shown in FIG. 1B.

Referring to FIG. 1B, the supporter 200 includes a seating portion 201, a suction channel portion 210, an accessory 300*a*, a hinge portion 400, and an unlocking portion 500.

The seating portion 201 extends from an upper end of the suction channel portion 210 and includes a seating recess 203 on which a lower portion of the vacuum cleaning unit 100 is removably seated.

The suction channel portion 210 has a lower end fluidly connected with the suction nozzle 110, and includes a mounting hole 211 formed at the upper end thereof to allow a suction pipe 101 of the vacuum cleaning unit 100 to be inserted therethrough. In this case, the mounting hole 211 guides the dirt drawn in the suction channel portion 210 to the suction pipe 101 of the vacuum cleaning unit 100. The suction channel portion 210 includes an inflow passage 212 formed from the lower end fluidly connected with the suction nozzle 110 to the mounting hole 211 of the upper end along the inside of the suction channel portion 210.

In addition, the suction channel portion 210 may be so high that a user is not required to bend his/her back to connect the accessory 300*a*.

Figure 2A:
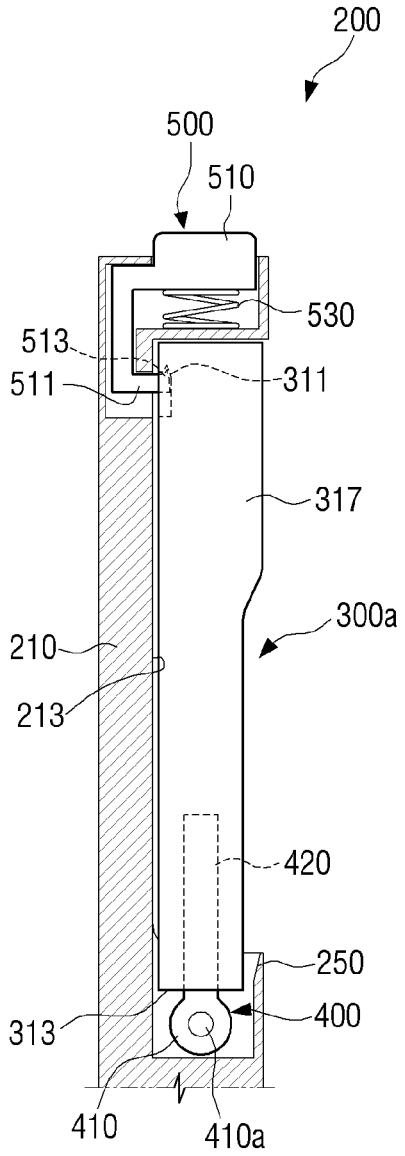
FIG. 2A is a partially enlarged cross section view illustrating the accessory which is mounted in a receiving recess of the supporter shown in FIG. 1A.
Figure 2B:
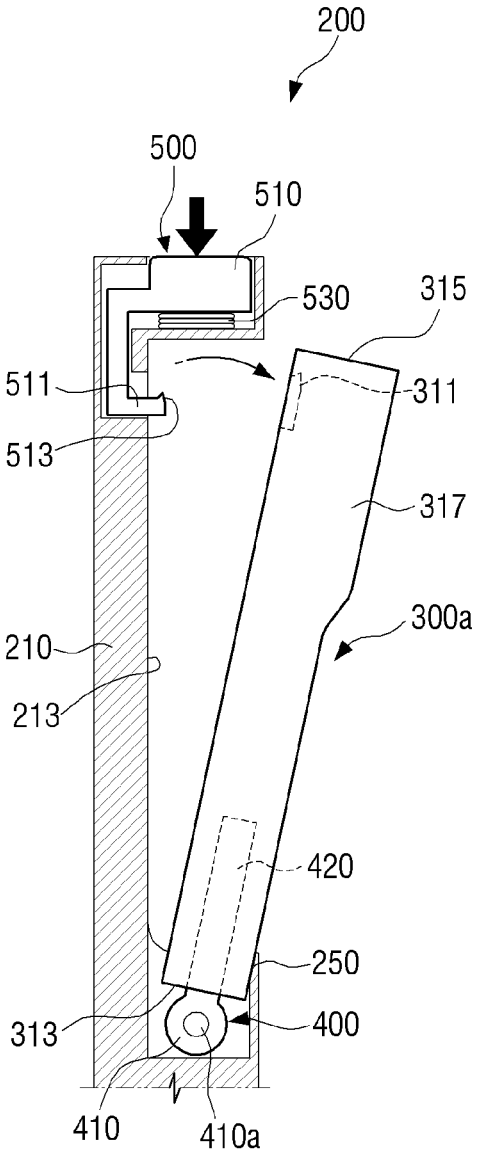
FIG. 2B is a partially enlarged cross section view illustrating the accessory being drawn out from the receiving recess of the supporter of FIG. 1B.

Referring to FIGS. 2A and 2B, the accessory 300*a* is connected with suction channel portion 210 to be received in or drawn out from a receiving recess 213 which is formed on one side of the suction channel portion 210 in a lengthwise direction. A lower end 313 of the accessory 300*a* is removably connected with the hinge portion 400, and a locking recess 311 is formed on one side surface facing the receiving recess 213 to allow an upper end 315 of the accessory 300*a* to be locked or unlocked by the unlocking portion 500.

In this case, a part 317 of the upper end 315 of the accessory 300*a* protrudes in the direction of being drawn out from the receiving recess 213. Accordingly, the accessory 300*a* is eccentrically placed such that its center of gravity is shifted from the center of the accessory 300*a* to the part 317 of the upper end 315. Such an eccentric placement of the center of gravity is to make the upper end 315 of the accessory 300*a* pivot in the direction of being drawn out by the gravity and to be drawn out from the receiving recess 213 when the upper end 315 of the accessory 300*a* is unlocked by the operation of the unlocking portion 500.

In response to the upper end 315 of the accessory 300*a* being drawn out from the receiving recess 213 as described above, the accessory 300*a* is slanted with the lower end 313 being fixed to the hinge portion 400. In this state, the user may separate the vacuum cleaning unit 100 from the supporter 200 and then connect the suction pipe 101 with the upper end 315 of the accessory 300*a* as shown in FIG. 10. Accordingly, the user can easily connect the accessory 300*a* with the vacuum cleaning unit 100 without having to bend his/her back.

The hinge portion 400 supports the accessory 300*a* to pivot by a predetermined angle. In this case, the hinge portion 400 restricts the pivoting angle by means of an extension projection 250 extending from the receiving recess 213.

As described above, the hinge portion 400 is placed in a lower portion of the receiving recess 213 and a lower portion 410 of the hinge portion 400 is hinged on an inner side of the receiving recess 213. The hinge portion 400 includes a pin connection portion 420 extending upwardly from the lower portion 410. The pin connection portion 420 is removably inserted into the accessory 300*a* through the lower end 313 of the accessory 300*a*.

The unlocking portion 500 is disposed on the suction channel portion 210 and includes an operating button 510 and an elastic member 530.

The operating button 510 has a part exposed to the outside of the suction channel portion 210 and the other part formed inside the suction channel portion 210. Such an operating button 510 is operated to ascend and descend on the suction channel portion 210.

In addition, the operating button 510 has an extension portion 511 extending downwardly toward one side and further extending toward the receiving recess 213. A locking protrusion 513 protrudes from an end of the extension portion 511 to the inside of the receiving recess 213.

In response to the accessory 300*a* being inserted into the receiving recess 213, the locking protrusion 513 is inserted into the locking recess 311. In this case, the accessory 300*a* received in the receiving recess 213 can be kept in this state by the locking protrusion 513.

The elastic member 530 is placed in the upper portion of the suction channel portion 210 and elastically supports the operating button 510 to move up to maintain the state in which the locking protrusion 513 is inserted into the locking recess 311 of the accessory 300*a*. In this case, the elastic member 530 may be a coil spring.

In the present exemplary embodiment configured as described above, the accessory 300*a* can be easily drawn out as shown in FIGS. 2A and 2B.

That is, when the accessory 300*a* is received in the receiving recess 213 as shown in FIG. 2A, the locking protrusion 513 of the operating button 510 is locked into the locking recess 311.

In this state, in order to draw out the accessory 300*a* from the receiving recess 213, the user presses the operating button 510 downwardly as shown in FIG. 2B. Then, the locking protrusion 513 is unlocked from the locking recess 311. Accordingly, as the center of gravity of the upper end of the accessory 300*a* is shifted to the outside of the receiving recess 213, the accessory 300*a* pivots in the direction of being drawn out from the receiving recess 213 by self weight of the accessory 300*a* and is slanted with the lower end 313 being fixed by the hinge portion 400.

The user separates the vacuum cleaning unit 100 from the supporter 200 with the accessory 300*a* being slanted as described above and connects the upper end 315 of the accessory 300*a* with the suction pipe 101, and then pulls the slanted accessory 300*a* upward. Then, the accessory 300*a* is disconnected from the pin connection portion 420 of the hinge portion 400.

After use of the accessory 300*a* is completed, a user may insert the accessory 300*a* back into the receiving recess 213. In order to insert the accessory 300*a* into the receiving recess 213, the user connects the lower end 313 of the accessory 300*a* which is connected with the suction pipe 101 of the vacuum cleaning unit 100 with the pin connection portion 420 of the hinge portion 400. In this state, the user disconnects the upper end 315 of the accessory 300*a* from the suction pipe 101 of the vacuum cleaning unit 100. Thereafter, the user pivots the accessory 300*a* toward the receiving recess 213 and makes the locking protrusion 513 of the operating button 510 locked into the locking recess 311. The sequence of steps discussed above is exemplary, and thus, the present disclosure is not limited thereto.

Figure 3A:
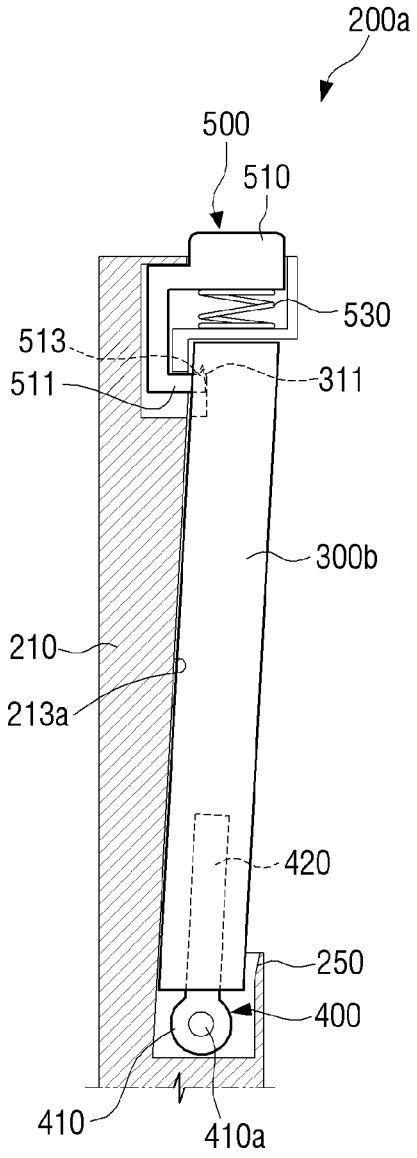
FIG. 3A is a partially enlarged cross section view illustrating an accessory being mounted in a receiving recess of a supporter of a stick type vacuum cleaner according to another exemplary embodiment.
Figure 3B:
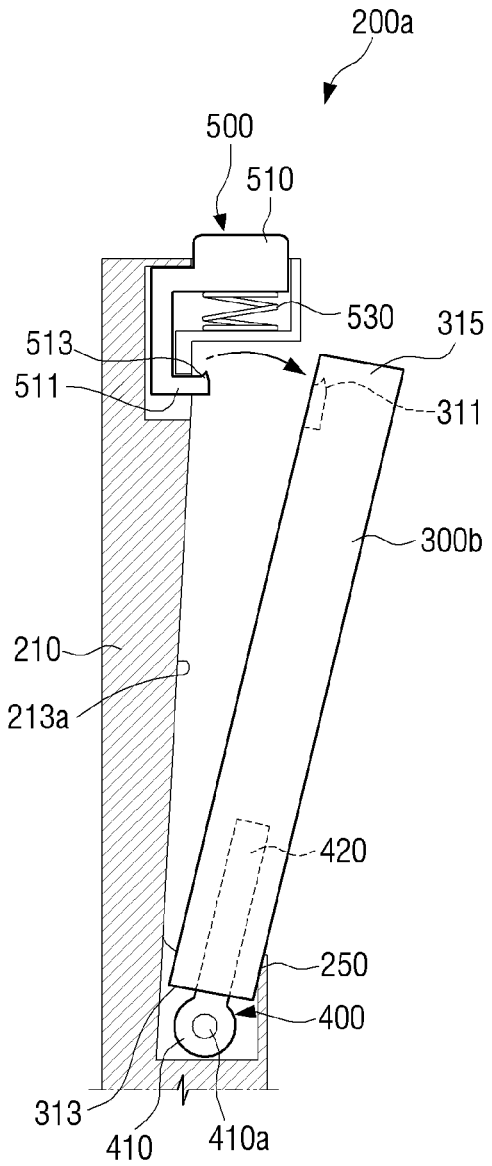
FIG. 3B is a partially enlarged cross section view illustrating the accessory being drawn out from the receiving recess of the supporter of the stick type vacuum cleaner according to the exemplary embodiment of FIG. 3A.

Referring to FIGS. 3A and 3B, most of the elements of another exemplary embodiment are the same as those of the above exemplary embodiment with respect to FIGS. 1A to 2B and a supporter 200*a* is slightly different from the supporter 200 of the exemplary embodiment with respect to FIGS. 1A-2B. In this exemplary embodiment, the same reference numerals as in the above discussed exemplary embodiment with respect to FIGS. 1A-2B are used for the same elements.

In this exemplary embodiment, an accessory 300*b* is received in a receiving recess 213*a* slantly in the direction of being drawn out from the receiving recess 213*a*.

In this case, the receiving recess 213*a* is slantly formed such that the upper end 315 of the accessory 300*b* further protrudes from the receiving recess 213*a* than the lower end 313 as shown in FIG. 3B. That is, the upper end 315 may be farther away from the receiving recess 213*a* than the lower end 313.

As described above, in the present exemplary embodiment, in response to the locking recess 311 of the accessory 300*b* being unlocked from the locking protrusion 513 by pressing the operating button 510 downwardly, the center of gravity of the accessory 300*b* is shifted to the outside of the receiving recess 213*a* due to the above-described slanted placement of the accessory 300*b* and thus the accessory 300*b* pivots and is drawn out from the receiving recess 213*a*.

In this case, the accessory 300*b* may not have the part 317 of the upper end 315 protruding, which is unlike the accessory 300*a* of the above exemplary embodiment with respect to FIGS. 1A-2B.

Figure 4A:
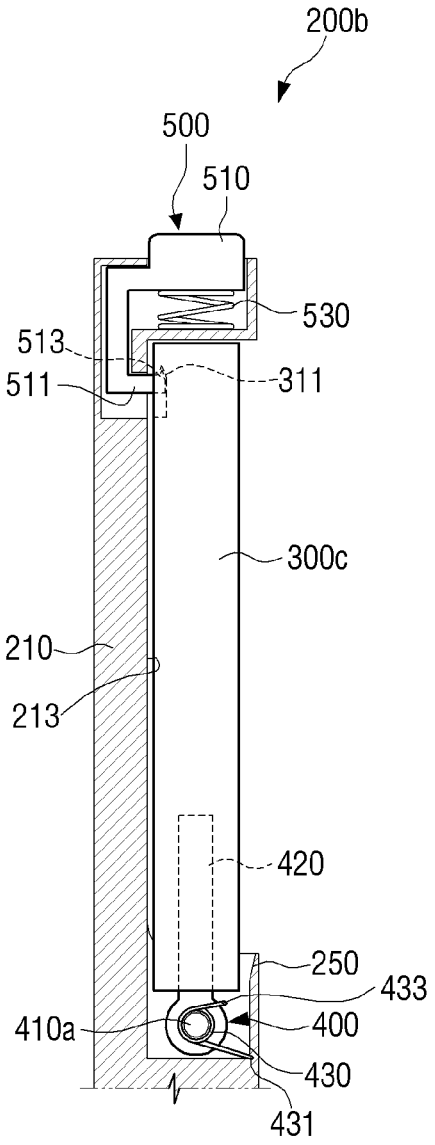
FIG. 4A is a partially enlarged cross section view illustrating an accessory being mounted in a receiving recess of a supporter of a stick type vacuum cleaner according to another exemplary embodiment.
Figure 4B:
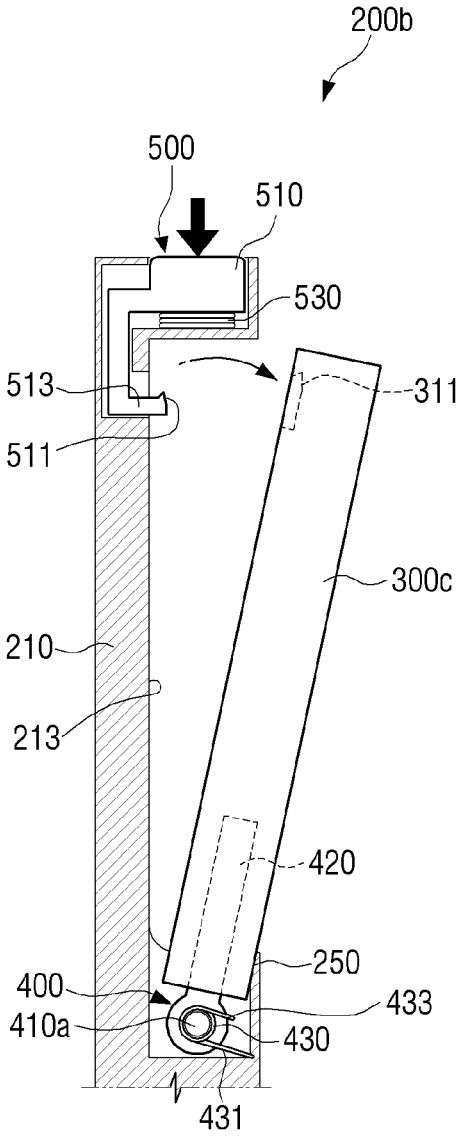
FIG. 4B is a partially enlarged cross section view illustrating the accessory being drawn out from the receiving recess of the supporter of the stick type vacuum cleaner according to the exemplary embodiment of FIG. 4A.

Referring to FIGS. 4A and 4B, most of the elements of another exemplary embodiment are the same as those of the above exemplary embodiment with respect to FIGS. 1A-2B and a supporter 200*b* is slightly different from the supporter 200 of the above exemplary embodiment. In the present exemplary embodiment referring to FIGS. 4A-4B, the same reference numerals as in the above exemplary embodiment are used for the same elements.

In the present exemplary embodiment, the stick type vacuum cleaner includes a torsion spring 430 to elastically support the hinge portion 400 in the receiving recess 213. In this case, the torsion spring 430 elastically supports the hinge portion 400 in the direction of being drawn out from the receiving recess 213.

The torsion spring 430 has one end 431 fixed to a part of the receiving recess 213 and the other end 433 fixed to a part of the hinge portion 400.

In the present exemplary embodiment, in response to the locking recess 311 of an accessory 300*c* being unlocked from the locking protrusion 513 by pressing the operating button 510 downwardly, the hinge portion 400 pivots in the direction of being drawn out from the receiving recess 213 by the above-described torsion spring 430, and thus, the accessory 300*c* is drawn out from the receiving recess 213 in a slanting position.

In this case, the accessory 300*c* may not have the part 317 of the upper end 315 protruding similar to the accessory 300*b* of the above exemplary embodiment with respect to FIGS. 3A-3B.

Figure 5A:
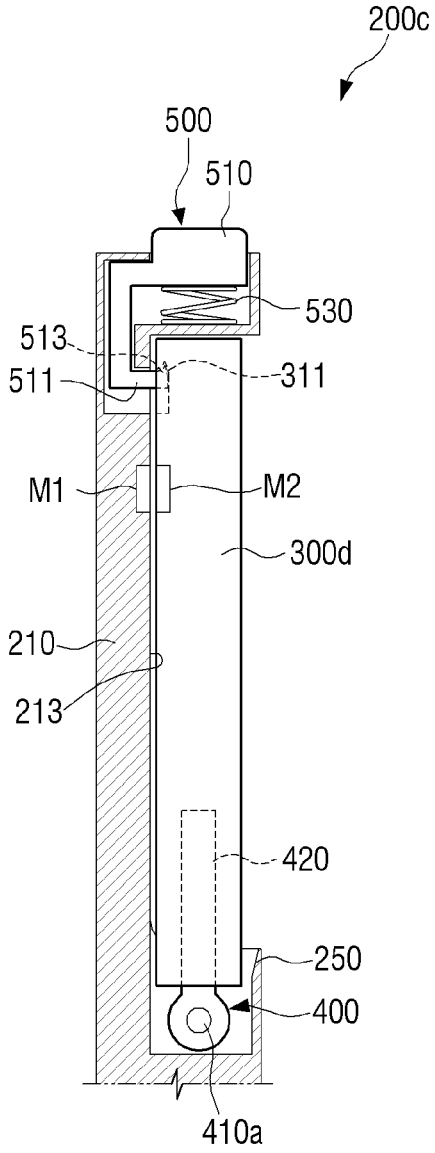
FIG. 5A is a partially enlarged cross section view illustrating an accessory being mounted in a receiving recess of a supporter of a stick type vacuum cleaner according to another exemplary embodiment.
Figure 5B:
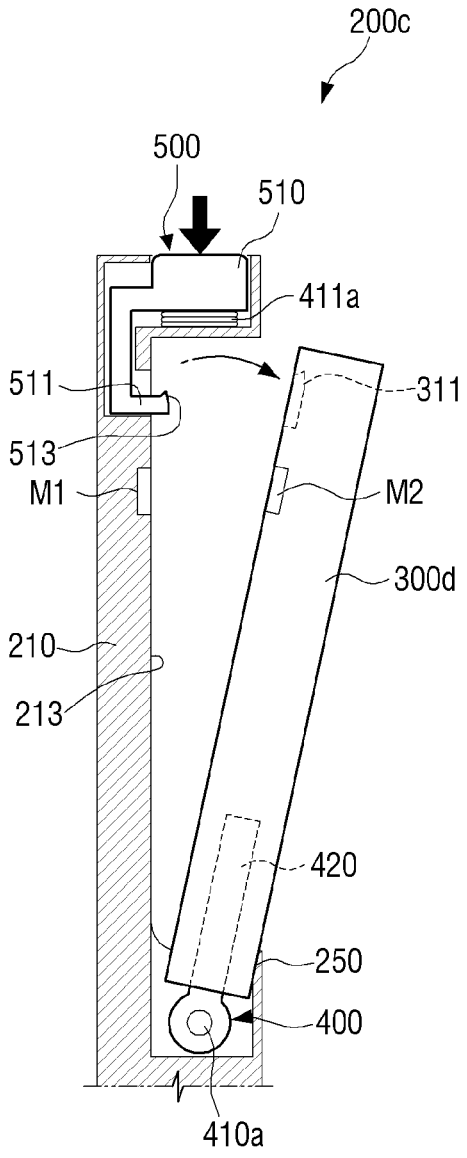
FIG. 5B is a partially enlarged cross section view illustrating the accessory being drawn out from the receiving recess of the supporter of the stick type vacuum cleaner according to the exemplary embodiment of FIG. 5A.

Referring to FIGS. 5A and 5B, most of the elements of another exemplary embodiment are the same as those of the above exemplary embodiment with respect to FIGS. 1A-2B and a supporter 200*c* is slightly different from the supporter 200 of the above exemplary embodiment. In the present exemplary embodiment, the same reference numerals as in the above exemplary embodiment are used for the same elements.

In the present exemplary embodiment, the stick type vacuum cleaner includes a first magnet M1 buried in the inside of the receiving recess 213 and a second magnet M2 buried in one side of an accessory 300*d*.

In this case, the first and second magnets M1 and M2 face each other when the accessory 300*d* is received in the receiving recess 213. In addition, the first and second magnets M1 and M2 have the same polarity on their facing surfaces.

Accordingly, in the present exemplary embodiment, in response to the locking recess 311 of the accessory 300*d* being unlocked from the locking protrusion 513 by pressing the operating button 510 downwardly, the hinge portion 400 pivots in the direction of being drawn out from the receiving recess 213 by a repulsive force exerted by the first and second magnets M1 and M2 on each other, and thus, the accessory 300*d* is drawn out from the receiving recess 213 in a slanting position.

In this case, the accessory 300*d* may not have the part 317 of the upper end 315 protruding similar to the accessories 300*b* and 300*c* of the above exemplary embodiments with respect to FIGS. 3A-3B and 4A-4B.

Figure 6A:
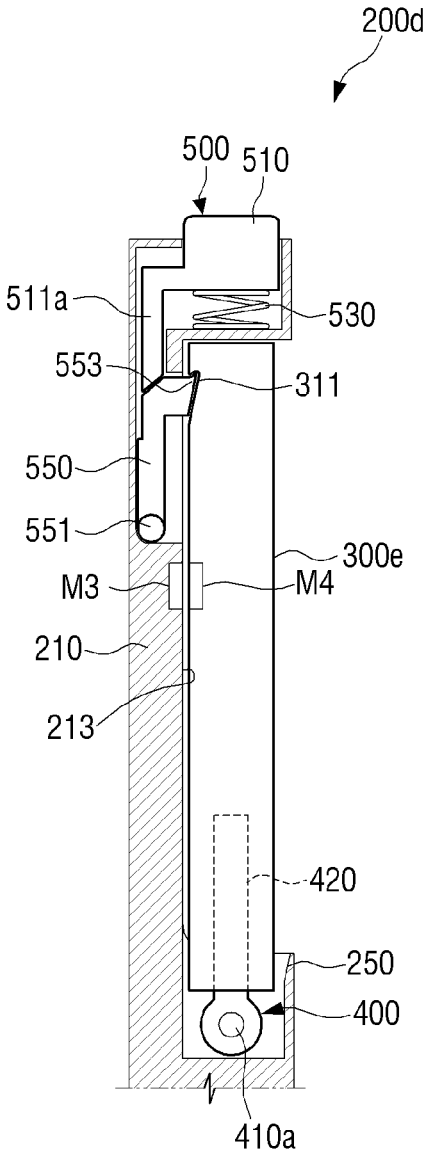
FIGS. 6A to 6C are partially enlarged cross section views illustrating a process of drawing an accessory out from a receiving recess of a supporter of a stick type vacuum cleaner in sequence according to another exemplary embodiment.
Figure 6B:
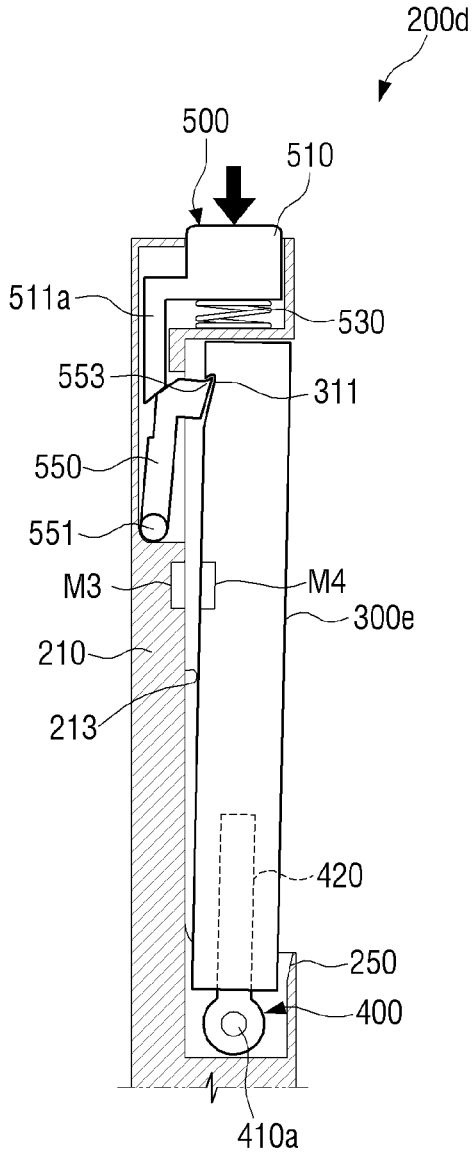
Figure 6C:
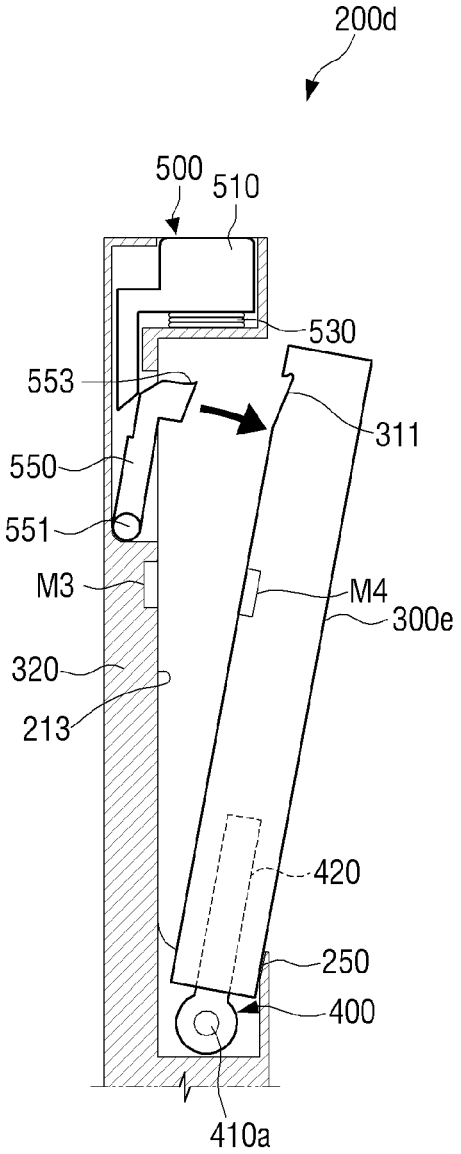

Referring to FIGS. 6A to 6C, most of the elements of another exemplary embodiment are the same as those of the above exemplary embodiment with respect to FIGS. 1A-2B and a supporter 200*d* and an unlocking portion 500 are slightly different from the supporter 200 and the unlocking portion 500 of the above exemplary embodiment. In the present exemplary embodiment, the same reference numerals as in the above exemplary embodiment with respect to FIGS. 1A-2B are used for the same elements.

The unlocking portion 500 of the present exemplary embodiment includes an operating button 510, an elastic member 530, and an operating rod 550.

The operating button 510 includes an extension portion 511*a* extending downwardly to one side and then extending toward the receiving recess 213. The operating rod 550 is placed on a lower portion of the extension portion 511*a* to be rotated on a hinge 551 in the receiving recess 213. A connection protrusion 553 is formed at one end of the operating rod 550 to be removably connected with the locking recess 311 of the upper end of an accessory 300*e*.

In this case, the stick type vacuum cleaner in the present exemplary embodiment includes a third magnet M3 buried in the inside of the receiving recess 213 and a fourth magnet M4 buried in one side of the accessory 300*d*.

In this case, the third and fourth magnets M3 and M4 face each other when the accessory 300*e* is received in the receiving recess 213. In addition, the third and fourth magnets M3 and M4 have the opposite polarity on their facing surfaces, and thus, exert attraction on each other.

In response to the accessory 300*e* being inserted into the receiving recess 213, the connection protrusion 553 is inserted into the locking recess 311. In this case, the accessory 300*e* received in the receiving recess 213 is kept in this state by the third and fourth magnets M3 and M4 in addition to the connection protrusion 553.

Accordingly, in the present exemplary embodiment, the locking recess 311 of the accessory 300*e* connected with the connection protrusion 553 is unlocked by pressing the operating button 510 downwardly as shown in FIG. 6B, and the operating rod 550 pushes the accessory 300*e* by using its rotational force. Accordingly, the hinge portion 400 pivots in the direction of being drawn out from the receiving recess 213 as shown in FIG. 6C, and thus, the accessory 300*e* is drawn out from the receiving recess 213 in a slanting position.

In this case, the accessory 300*e* may not have the part 317 of the upper end 315 protruding similar to the accessories 300*b* and 300*c* of the above exemplary embodiments with respect to FIGS. 3A-3B and 4A-4B.

Hereinafter, an accessory being mounted in a receiving recess of a supporter of a stick type vacuum cleaner and the accessory being drawn out from the receiving recess of the supporter according to another exemplary embodiment will be explained with reference to FIGS. 7A and 7B. The same elements as in the above exemplary embodiments will not be explained in detail.

Figure 7A:
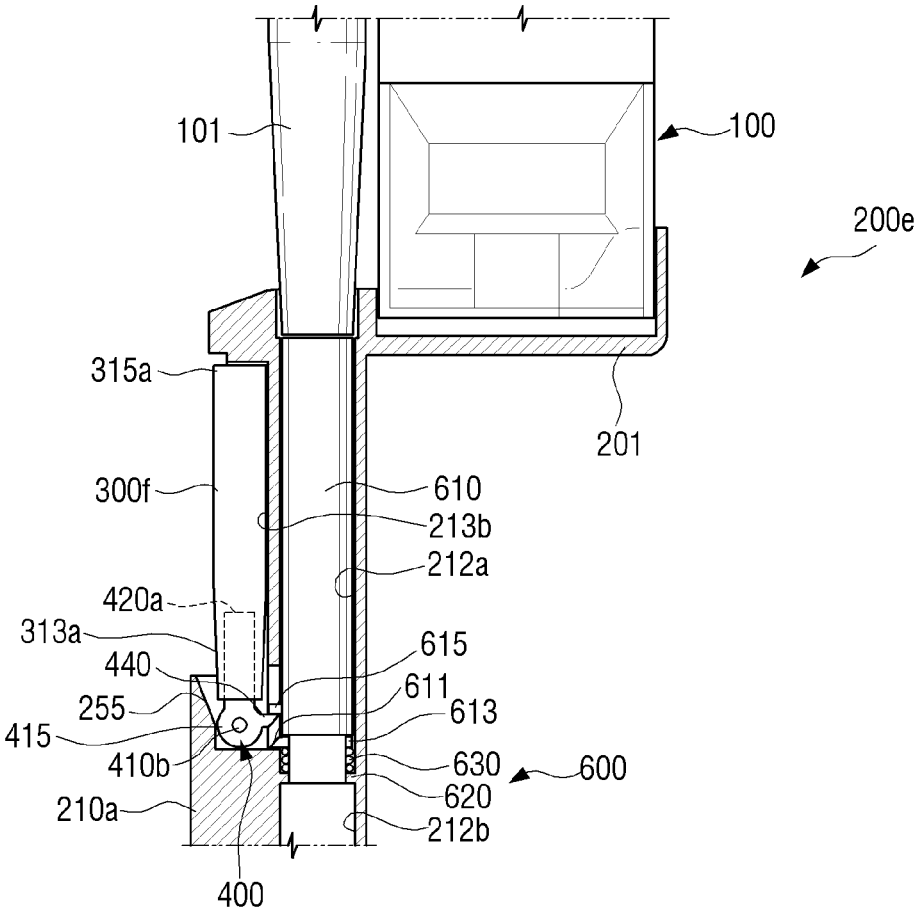
FIG. 7A is a partially enlarged cross section view illustrating an accessory being mounted in a receiving recess of a supporter of a stick type vacuum cleaner according to another exemplary embodiment.

Referring to FIG. 7A, an accessory 300*f* is removably connected with a receiving recess 213*b* which is formed on one side of a suction channel portion 210*a* in a lengthwise direction of the suction channel portion 210*a*. A lower end 313*a* of the accessory 300*f* is removably connected with the hinge portion 400.

The hinge portion 400 supports the accessory 300*f* to pivot by a predetermined angle. In this case, the hinge portion 400 restricts the pivoting angle by means of an extension projection 255 extending from the receiving recess 213*b*.

The hinge portion 400 is placed in a lower portion of the receiving recess 213*b*, and a lower portion 415 of the hinge portion 400 is hinged on an inner side of the receiving recess 213*b*. The hinge portion 400 includes a pin connection portion 420*a* extending upwardly from the lower portion 415. The pin connection portion 420*a* is removably inserted into the accessory 300*f* through the lower end 313*a* of the accessory 300*f*.

An unlocking portion 600 is formed in inflow passages 212*a* and 212*b* formed along the inside of the suction channel portion 210*a*, and includes a moving member 610, a locking protrusion 440 of the hinge portion, and an elastic member 630.

The moving member 610 is formed to ascend and descend along the inflow passage 212*a*, and is pressed by self-weight of the vacuum cleaning unit 100 in response to the vacuum cleaning unit 100 being connected with the supporter 200*e* and is kept in a descending state, and ascends by the elastic member 630 in response to the vacuum cleaning unit 100 being disconnected from the suction channel portion 210*a*.

In this case, the moving member 610 includes first and second push protrusions 611 and 615 formed on locations corresponding to the hinge portion 400. A moving ring 613 is connected with a lower end of the moving member 610 and the first push protrusion 611 is formed at one end of the moving ring 613. The second push protrusion 615 is formed higher than the first push protrusion 611.

The hinge portion 400 includes the locking protrusion 440 formed on a location corresponding to the first and second protrusions 611 and 615. The locking protrusion 440 is formed to be located between the first push protrusion 611 and the second push protrusion 615.

The elastic member 630 is located between a lower portion of the moving ring 613 and an elastic member support portion 620. In response to the vacuum cleaning unit 100 being drawn out from the supporter 200*e*, the elastic member 630 elastically supports the moving member 610 to move up. In this case, the elastic member 630 may be a coil spring.

Figure 7B:
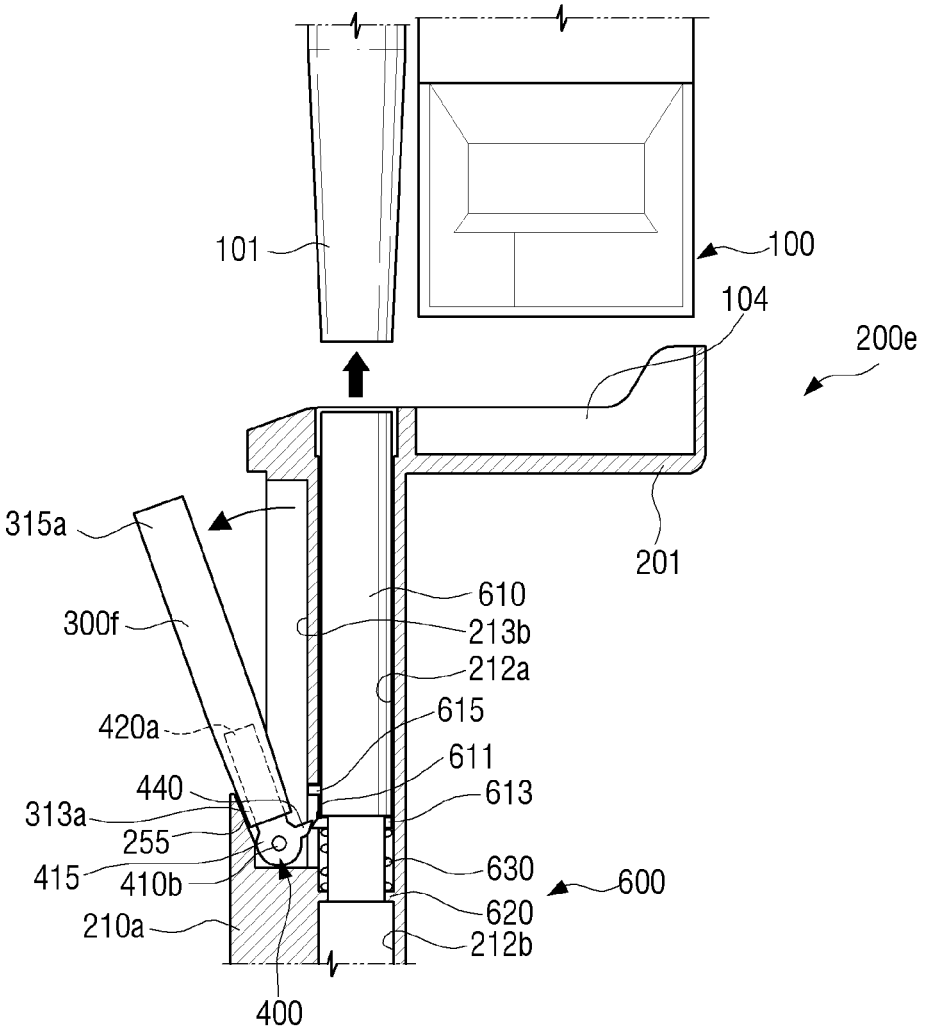
FIG. 7B is a partially enlarged cross section view illustrating the accessory being drawn out from the receiving recess of the supporter of the stick type vacuum cleaner according to the exemplary embodiment of FIG. 7A.

That is, according to the present exemplary embodiment configured as described above, the accessory 300*f* can be automatically drawn out as shown in FIGS. 7A and 7B.

In response to the vacuum cleaning unit 100 being separated from the supporter 200*e* by the user, a pressure generated by self-weight exerted to the inflow passage 212*a* by the suction pipe 101 of the vacuum cleaning unit 100 is released as shown in FIG. 7B. Accordingly, the first push protrusion 611 moves up by a recovering force of the elastic member 630. Accordingly, the first push protrusion 611 is brought into contact with the locking protrusion 440 and moves up, such that the hinge portion 400 pivots up to the extension projection 255. Accordingly, the accessory 300*f* pivots in the direction of being drawn out from the receiving recess 213*b* and is slantly placed.

The user connects an upper end 315*a* of the slanted accessory 300*f* with the suction pipe 101 of the vacuum cleaning unit 100, and then pulls the slanted accessory 300*f* upward. Then, the accessory 300*f* is disconnected from the pin connection portion 420*a* of the hinge portion 400.

In order to replace the accessory 300*f* after use, the user connects the accessory 300*f* with the pin connection portion 420*a* and then connects the suction pipe 101 of the vacuum cleaning unit 100 with the inflow passage 212*a* as shown in FIG. 7A. Then, a part of the self-weight of the vacuum cleaning unit 100 is exerted to the moving member 610. Accordingly, the second push protrusion 615 formed on the moving member 610 rotates the locking protrusion 440 of the hinge portion 400 in a downward direction such that the accessory 300*f* is received in the receiving recess 213*b*.

Hereinafter, an accessory being mounted in a receiving recess of a supporter of a stick type vacuum cleaner and the accessory being drawn out from the receiving recess according to another exemplary embodiment will be explained with reference to FIGS. 8A and 8B.

Figure 8A:
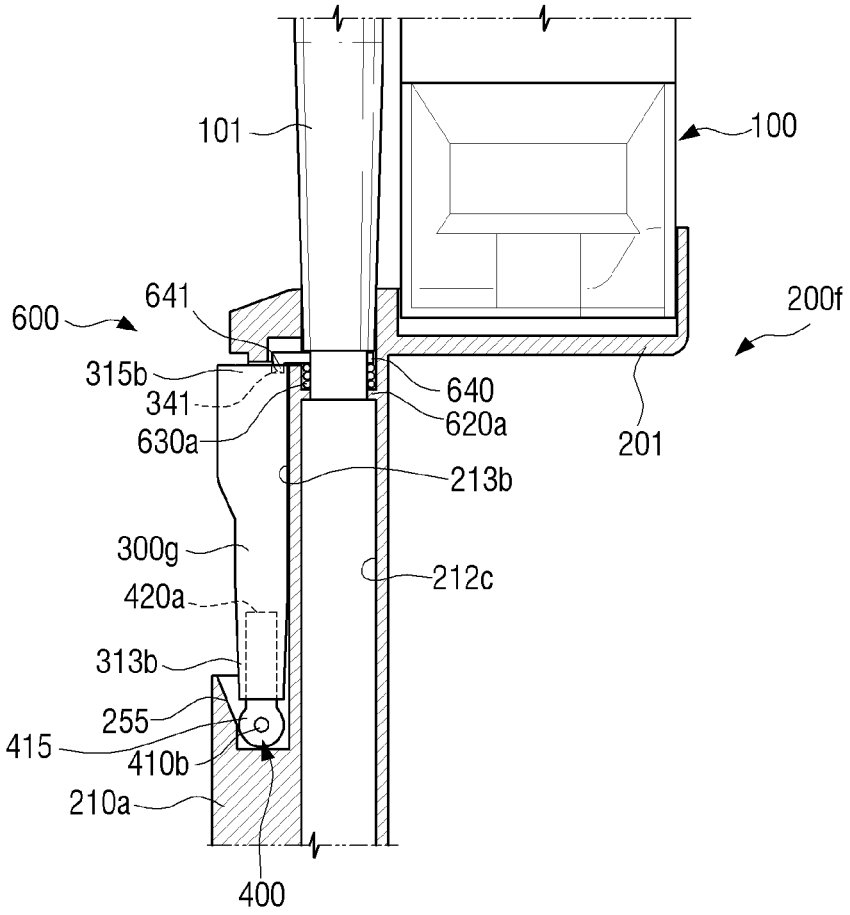
FIG. 8A is a partially enlarged cross section view illustrating an accessory being mounted in a receiving recess of a supporter of a stick type vacuum cleaner according to another exemplary embodiment.
Figure 8B:
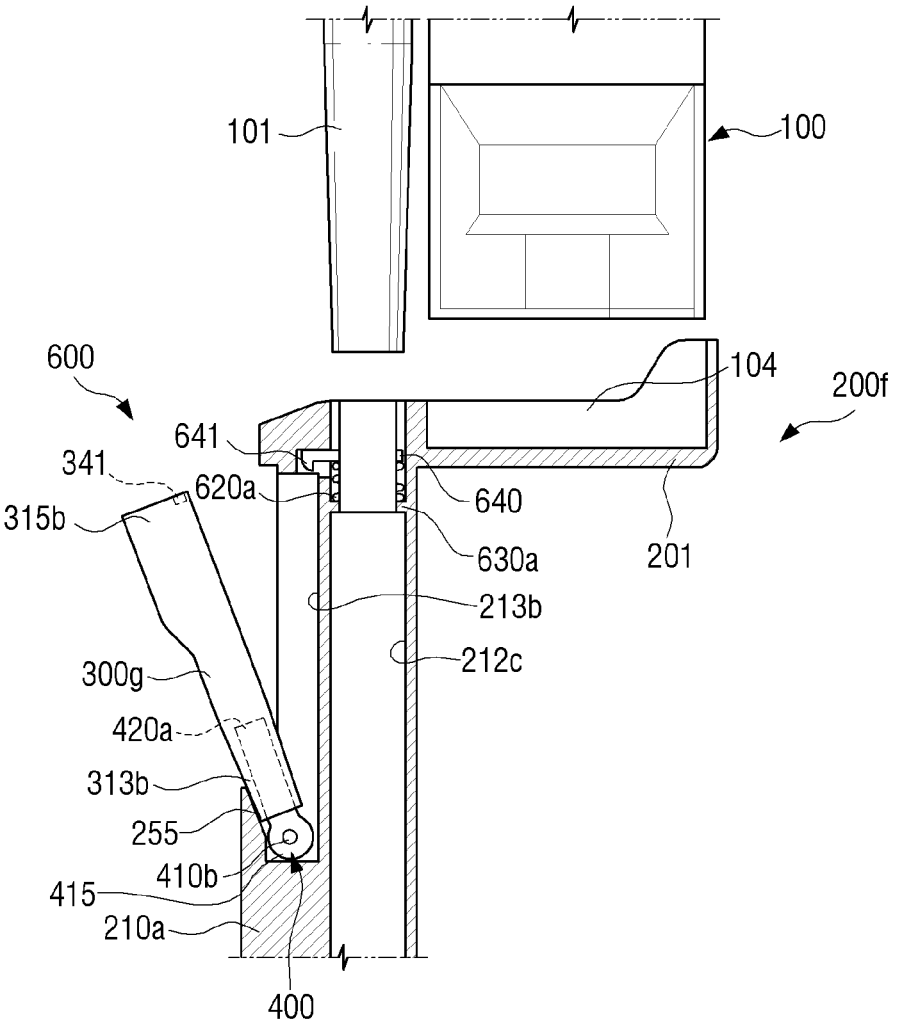
FIG. 8B is a partially enlarged cross section view illustrating the accessory being drawn out from the receiving recess of the supporter of the stick type vacuum cleaner according to the exemplary embodiment of FIG. 8A.

Referring to FIGS. 8A and 8B, most of the elements of the present exemplary embodiment are the same as those of the above exemplary embodiment with respect to FIGS. 7A-7B and a supporter 200*f* and an unlocking portion 600 are slightly different from those of the present exemplary embodiment. In the present exemplary embodiment, the same reference numerals as in the above exemplary embodiment with respect to FIGS. 7A-7B are used for the same elements.

In the present exemplary embodiment, the unlocking portion 600 includes a moving member 640, an elastic member 630*a*, and a locking protrusion 641.

The moving member 640 is configured to ascend and descend above an accessory 300*g*, and the elastic member 630*a* is formed on a lower portion of the moving member 640. The elastic member 630*a* elastically supports the moving member 640 to move up by using a fixing ring 620*a* formed under the elastic member 630*a*.

A locking protrusion 641 is formed at one end of the moving member 640. The locking protrusion 641 is formed to be inserted into a connection recess 341 formed on one side of an upper end 315*b* of the accessory 300*g*.

To pivot to the outside of the supporter 200*f*, the accessory 300*g* may have the center of gravity at an upper end. The center of gravity is shifted in the direction in which the accessory 300*g* is drawn out from the receiving recess 213*b*.

In response to the vacuum cleaning unit 100 being separated from the supporter 200*f* by the user, a pressure generated by self-weight exerted to the fixing ring 620*a* and the moving member 640 formed on the upper portion of an inflow passage 212*c* by the suction pipe 101 of the vacuum cleaning unit 100 is released. Accordingly, the moving member 640 moves up by a recovering force of the elastic member 630*a*. As a result, the locking protrusion 641 moves up and is unlocked from the connection recess 341 of the accessory 300*g*. In this case, the accessory 300*g* pivots to the outside of the supporter 200*f* and pivots up to the extension projection 255, at which point the accessory 300*g* remains at it position.

The user connects an upper end 315*b* of the slanted accessory 300*g* with the suction pipe 101 of the vacuum cleaning unit 100, and then pulls the slanted accessory 300*g* upward. Then, the accessory 300*g* is disconnected from the pin connection portion 420*a* of the hinge portion 400.

In order to replace the accessory 300*g* in its original position after using the accessory 300*g*, the user connects a lower portion 313*b* of the accessory 300*g* with the pin connection portion 420*a*, pushes the accessory 300*g* into the receiving recess 213*b*, and then connects the suction pipe 101 of the vacuum cleaning unit 100 with the inflow passage 212*d*. Then, a part of the self-weight of the vacuum cleaning unit 100 is exerted to the moving member 640. Accordingly, the locking protrusion 641 of the moving member 640 is inserted into the connection recess 341 of the accessory 300*g* such that the accessory 300*g* is received in the receiving recess 213*b*.

In this exemplary embodiment, the center of gravity of the accessory 300*g* is located at the upper end and thus the accessory 300*g* is shifted in the direction in which the accessory 300*g* is drawn out from the receiving recess 213*b*. However, this should not be considered as limiting. A first magnet and a second magnet having the same polarity may be formed on the receiving recess 213*b* and the accessory 300*g*, respectively, a torsion spring (not shown) having elasticity may be formed to allow the hinge portion 400 to pivot to the outside of the receiving recess 213*b*, or the accessory 300*g* may be slanted in the receiving recess 213*b* in the direction of being drawn out from the receiving recess 213*b*. That is, the accessory 300*g* may be separated from the receiving recess using any of the example embodiments with respect to at least FIGS. 1A-8B discussed above in the present disclosure.

Figure 9A:
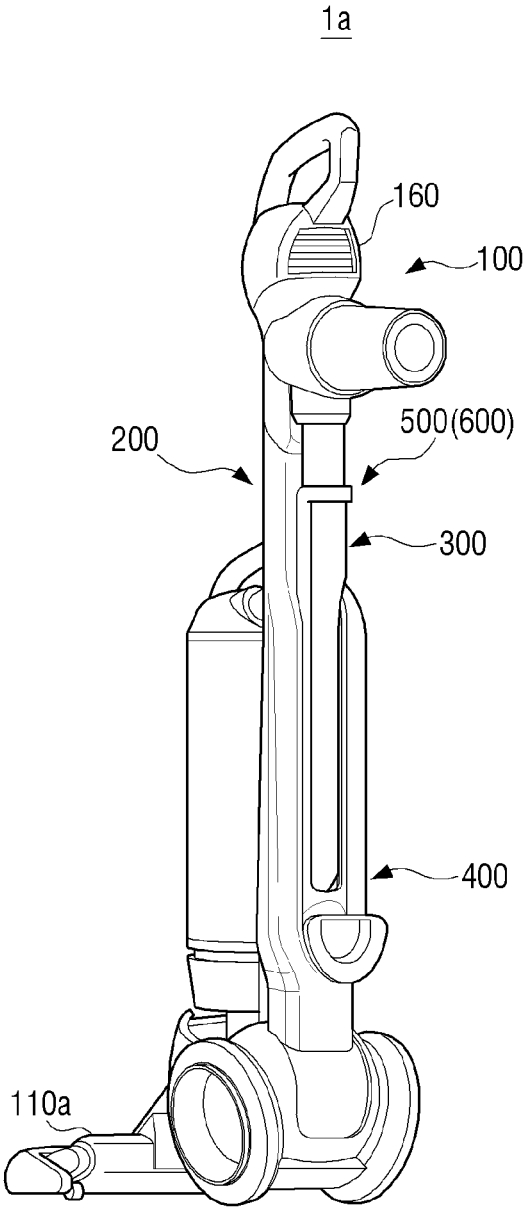
FIGS. 9A and 9B are perspective views illustrating an upright type vacuum cleaner to which a supporter of any one of the above exemplary embodiments is applied.
Figure 9B:
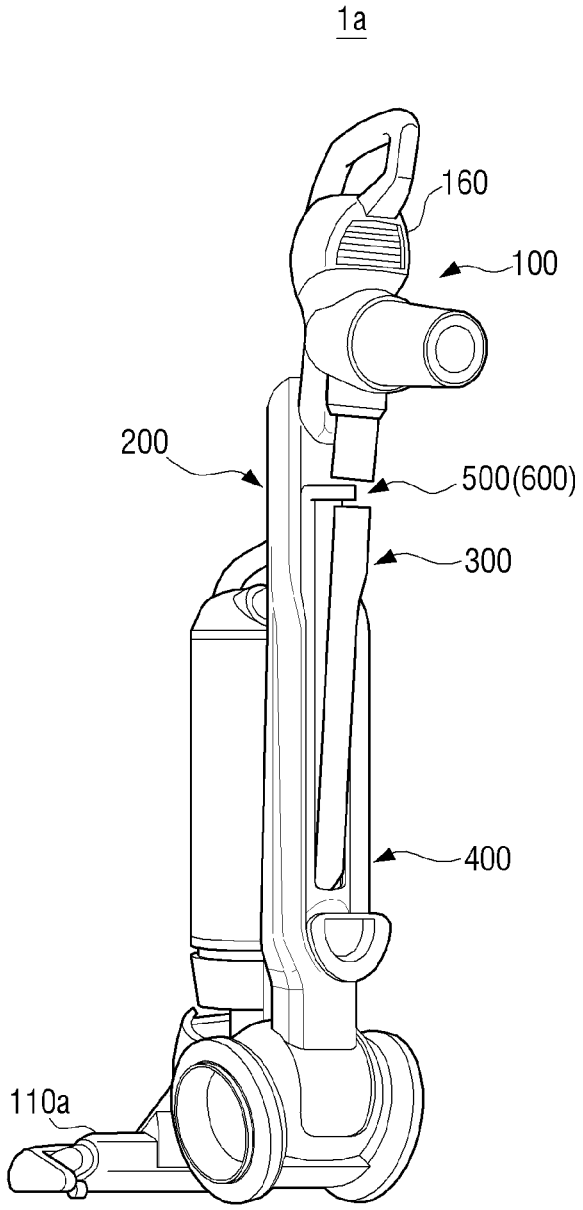
Figure 9C:
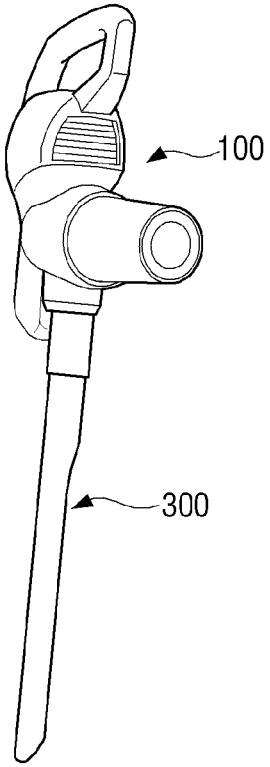
FIG. 9C is a perspective view illustrating an accessory being mounted in the vacuum cleaning unit shown in FIG. 9B.

FIGS. 9A and 9B illustrate an upright type cleaner to which one of the supporters according to the above exemplary embodiments is applied, and FIG. 9C illustrates an accessory being mounted on a vacuum cleaning unit.

For example, the upright type cleaner 1*a* includes a suction nozzle 110*a*, a cleaner body (not shown) having a lower end fluidly connected with the suction nozzle 110*a* by means of a hinge, and a supporter 200 fluidly connected with the suction nozzle 110*a* and supporting the cleaner body (not shown).

The supporter 200 includes a suction channel portion (not shown) having one end removably connected with a vacuum cleaning unit 100 and the other end connected with the suction nozzle 110*a* to guide dirt drawn in through the suction nozzle 110*a* to the vacuum cleaning unit 100.

In addition, the supporter 200 includes an accessory 300 received in a receiving recess (not shown) formed on one side of the suction channel portion (not shown), and a hinge portion which is placed in the receiving recess (not shown) and has one end connected with the suction channel portion (not shown) by means of a hinge and the other end removably inserted into a lower end of the accessory 300, thereby supporting the accessory 300 to pivot by a predetermined angle. In addition, the vacuum cleaner includes an unlocking portion 500 or 600 which is disposed in the suction channel portion (not shown) and locks or unlocks the accessory 300 with respect to the receiving recess (not shown).

By separating the vacuum cleaning unit 100 from the supporter 200, the accessory 300 is pivoted with respect to the suction channel portion (not shown) by the unlocking portion 500 or 600. The vacuum cleaning unit 100 is connected with the accessory 300 which pivots by a predetermined angle. Therefore, it is possible to clean a narrow space easily. In this case, the vacuum cleaning unit 100 may be configured in the form of a handy type vacuum cleaner.

Figure 10A:
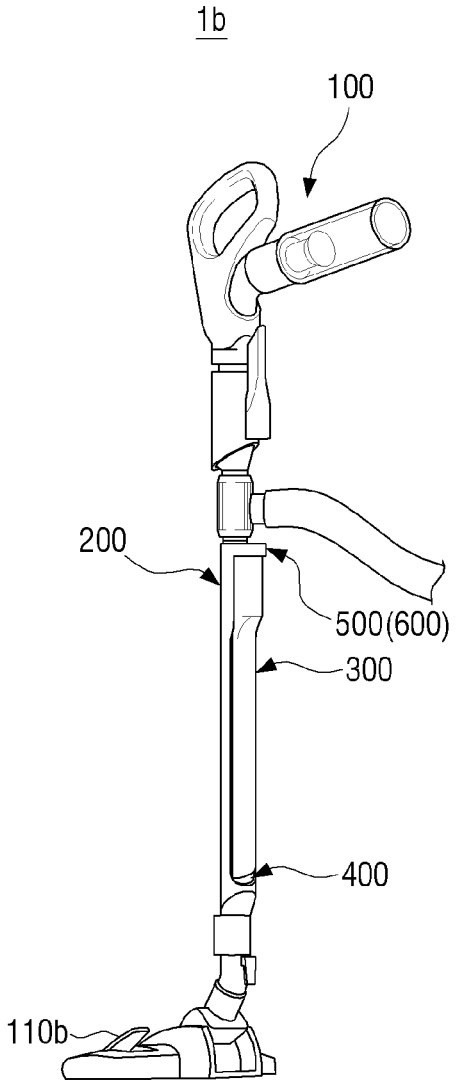
FIGS. 10A and 10B are perspective views illustrating a canister type vacuum cleaner to which a supporter of any one of the above exemplary embodiments is applied.
Figure 10B:
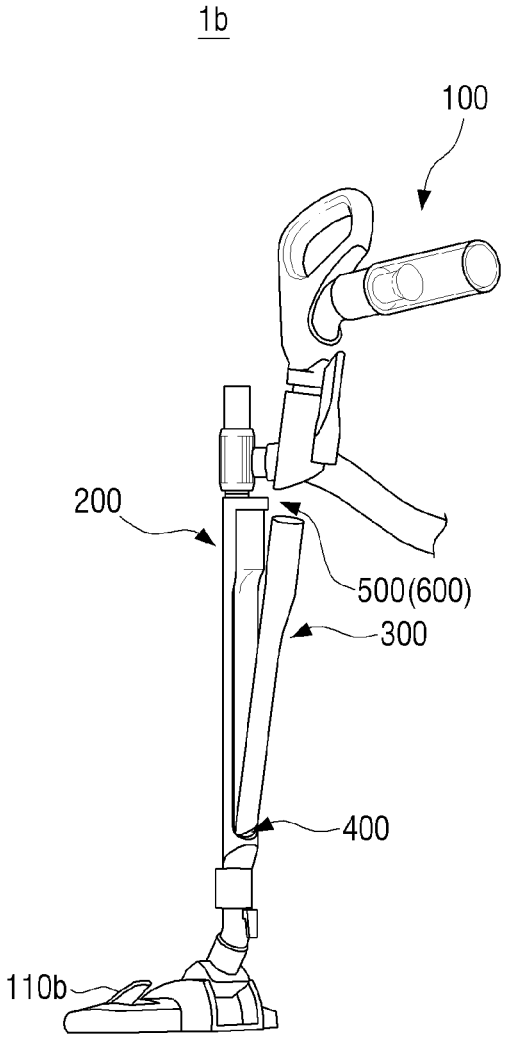
Figure 10C:
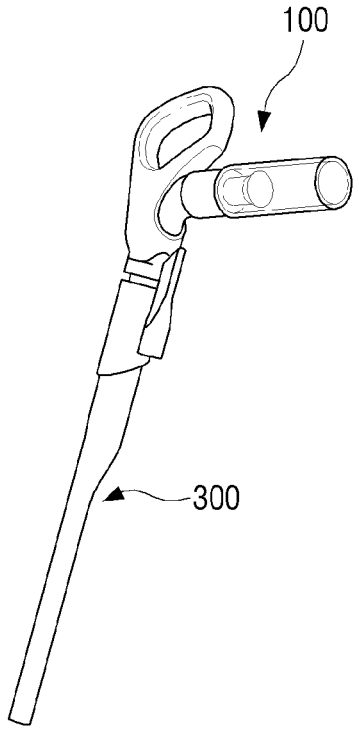
FIG. 10C is a perspective view illustrating an accessory being mounted in the vacuum cleaning unit shown in FIG. 10B.

FIGS. 10A and 10B illustrates a canister type cleaner to which one of the supporters according to the above exemplary embodiments is applied, and FIG. 10C illustrates an accessory being mounted on a vacuum cleaning unit.

For example, the canister type vacuum cleaner 1*b* includes a suction nozzle 110*b*, a supporter 200 fluidly connected with the suction nozzle 110*b*, and a cleaner body (not shown) fluidly connected with the supporter 200.

The supporter 200 includes a suction channel portion (not shown) having one end removably connected with a vacuum cleaning unit 100 and the other end connected with the suction nozzle 110*a* to guide dirt drawn in through the suction nozzle 110*a* to the vacuum cleaning unit 100.

In addition, the supporter 200 includes an accessory 300 received in a receiving recess (not shown) formed on one side of the suction channel portion (not shown), a hinge portion 400 which is placed in the receiving recess (not shown) and has one end connected with the suction channel portion (not shown) by means of a hinge and the other end removably inserted into a lower end of the accessory 300, thereby supporting the accessory 300 to pivot by a predetermined angle, and an unlocking portion 500 or 600 which is disposed in the suction channel portion (not shown) and locks or unlocks the accessory 300 with respect to the receiving recess (not shown).

A detailed operation of the canister type vacuum cleaner 1*b* is the same as or similar to that of the upright type cleaner.

Figure 11A:
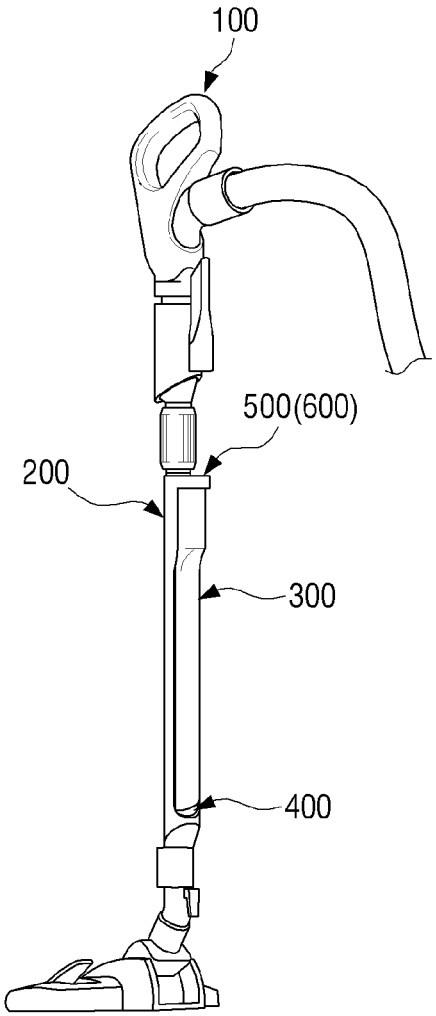
FIGS. 11A and 11B are perspective views illustrating a canister type vacuum cleaner to which a supporter of any one of the above exemplary embodiments is applied, and from which a vacuum cleaning unit is omitted.
Figure 11B:
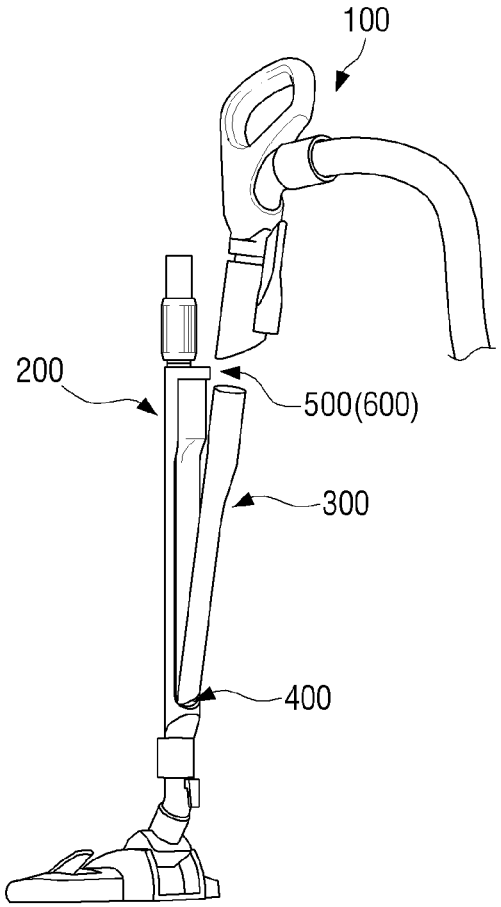
Figure 11C:
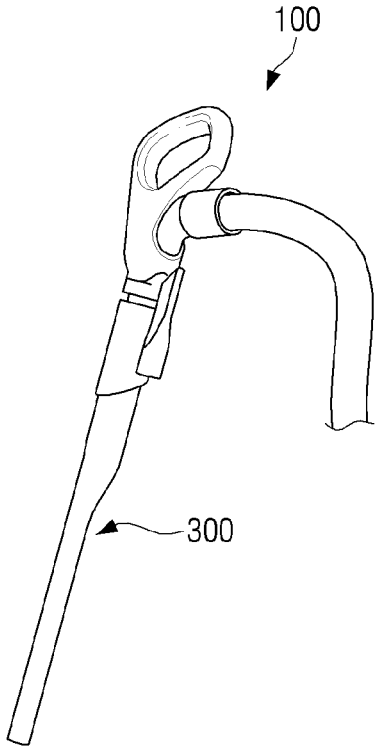
FIG. 11C is a perspective view illustrating an accessory being connected with a handle shown in FIG. 11B.

FIGS. 11A and 11B illustrate another canister type vacuum cleaner to which one of the supporters according to the above exemplary embodiments is applied, and from which a vacuum cleaning unit is omitted, and FIG. 11C is a view showing an accessory being mounted on a handle shown in FIG. 11B.

In the case of the canister type, a handy type cleaner is removably mounted on a supporter of the vacuum cleaner as shown in FIGS. 9A to 9C, and also, a supporter may be applied to an extension pipe as shown in FIGS. 11A to 11C, so that the user can easily mount and dismount the accessory and easily clean a narrow area and a broad area.

Hereinafter, a standing structure of a stick type vacuum cleaner according to another exemplary embodiment will be explained.

Figure 12A:
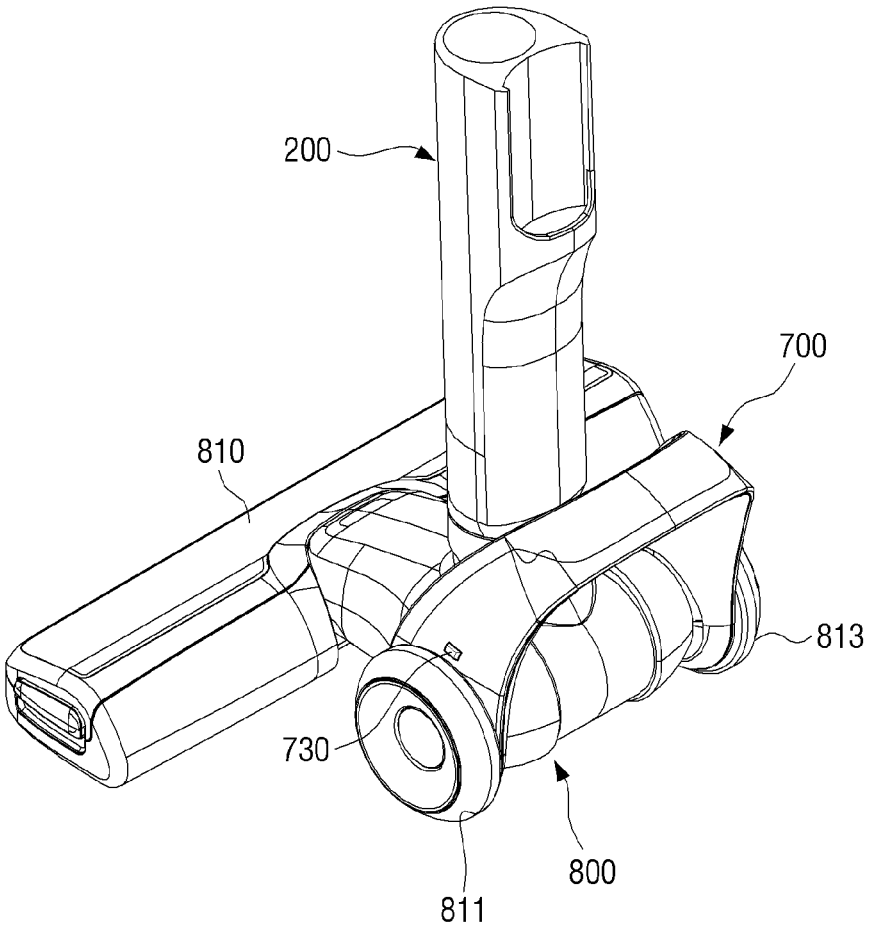
FIGS. 12A and 12B are perspective views illustrating an operation of a standing structure applied to a stick type vacuum cleaner according to an exemplary embodiment.
Figure 12B:
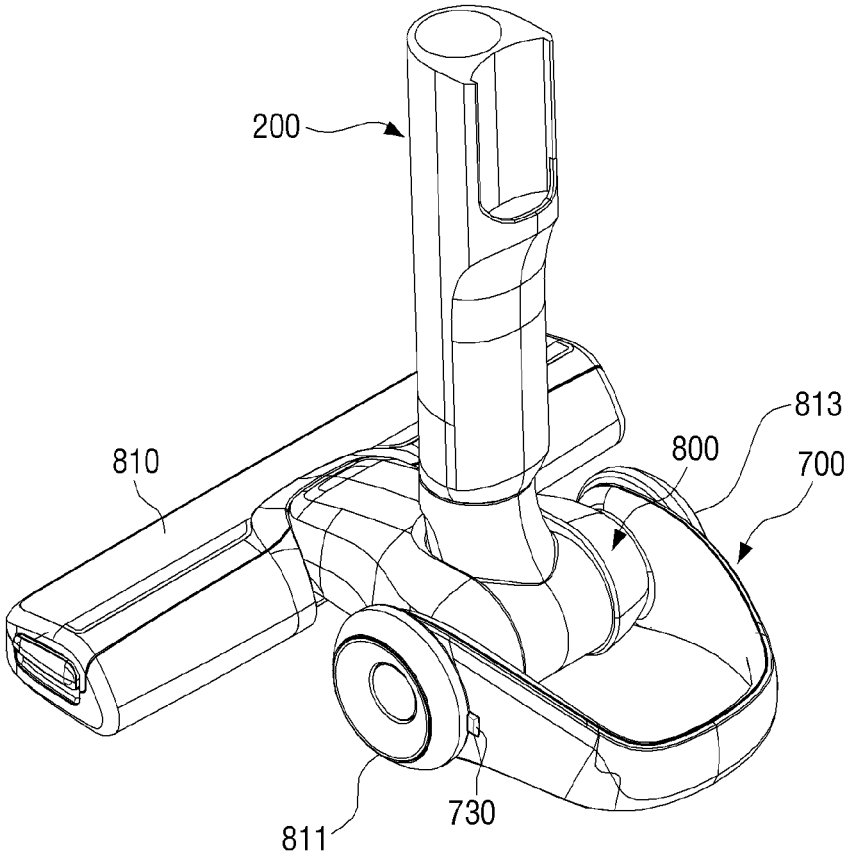

FIGS. 12A and 12B are views showing an operation of a kick-standing structure which is applied to a stick type vacuum cleaner according to an exemplary embodiment.

The user may need to erect the cleaner on a floor surface to mount an accessory in the middle of cleaning a wide area. In this case, in response to the user stepping on a stand 710, the cleaner is erected on the floor surface by the area of the stand 710 and a suction nozzle 810.

In response to the cleaner being erected by the stand 710 as described above, the user can separate the accessory (not shown) from a supporter 200 and can easily connect the accessory with a vacuum cleaning unit (not shown).

Figure 13A:
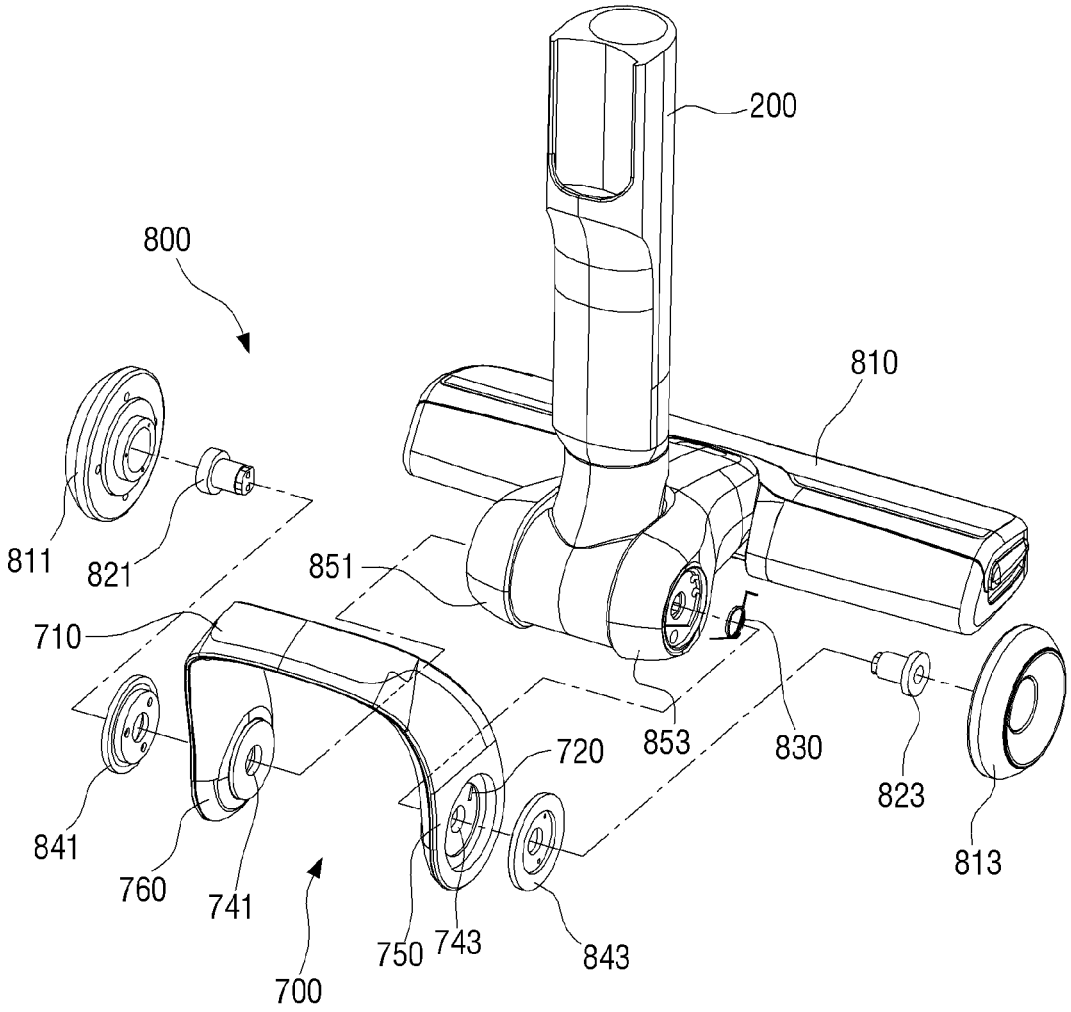
FIGS. 13A and 13B are exploded perspective view illustrating the standing structure shown in FIG. 12A.
Figure 13B:
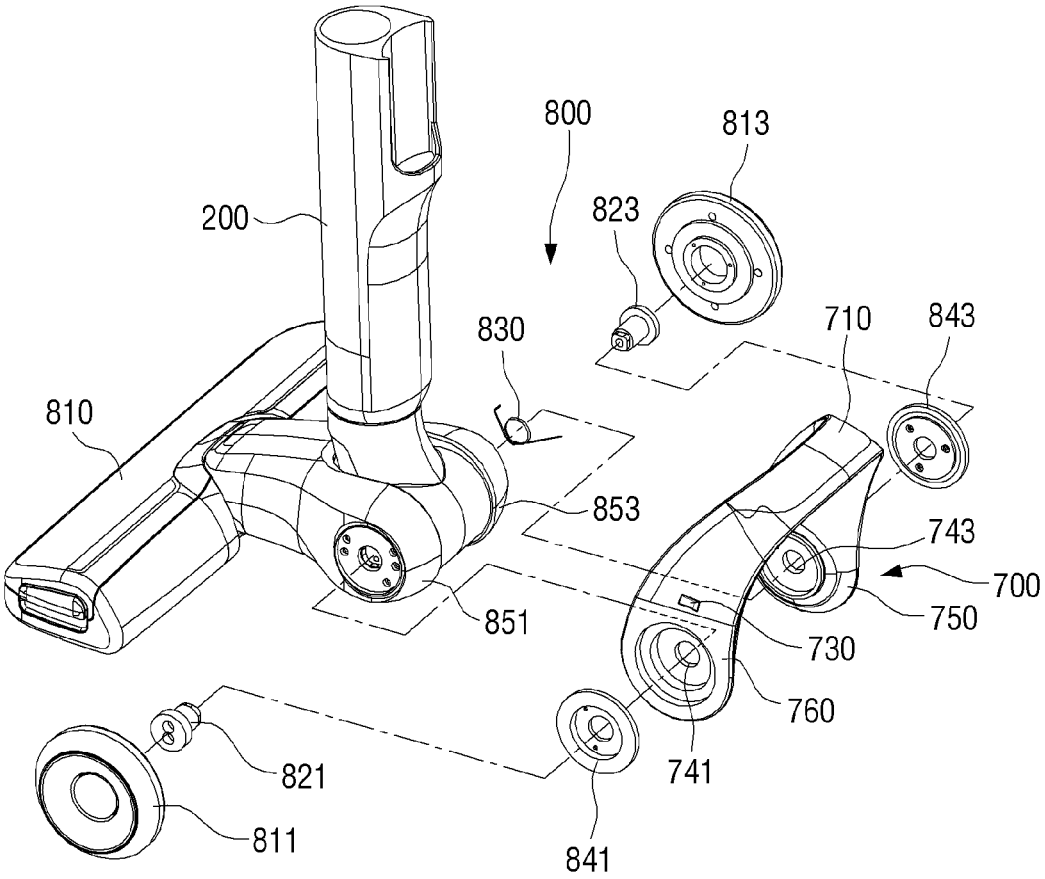

FIGS. 13A and 13B are exploded perspective views of a standing structure. The standing structure includes a driving portion 800 and a kick-stand portion 700. The driving portion 800 is connected with the suction nozzle 810 and includes left and right fixing portions 851 and 853 arranged on the left and the right with reference to a lower portion of the supporter 200.

A rotary spring 830 is connected with the right fixing portion 853 and a right portion 750 of the kick-stand portion 700 is connected with the right fixing portion 853. A fixing ring 843 is mounted in the right portion 750 of the kick-stand portion 700, and a fixing shaft 823 is configured to connect the fixing ring 843, the right portion 750 of the stand, and the rotary spring 830 with the right fixing portion 853. A wheel 813 is rotatably supported by the fixing shaft 823 outside the fixing shaft 823.

An external portion of the left fixing portion 851 has the same or similar configuration as that of the right portion of the right fixing portion 853 except for that the rotary spring 830 is not mounted in the left fixing portion 851. Accordingly, a redundant explanation is omitted. The location of the rotary spring 830 is not limited to the right fixing portion 853, and may be located at another area, for example, the left fixing portion 851 instead.

A lower end of the supporter 200 is located between the left and right fixing portions 851 and 853 and can be freely moved up and down by a predetermined angle by a guide recess (not shown) formed in the left and right fixing portions 851 and 853. Accordingly, the user can lean the cleaner by an optimum angle to clean the floor surface.

The kick-stand portion 700 includes a stand 710, a first rotary spring connection recess 720, a friction protrusion 730, connection holes 741 and 743 connected with the fixing shafts 821 and 823, and left and right stand portions 750 and 760.

The stand 710 is rotated about the fixing shafts 821 and 823. The first rotary spring connection recess 720 is formed adjacent to the connection hole 743 of the right portion 750 of the stand 710. The friction protrusion 730 is formed right above the left portion 760 of the stand.

As will be explained below, the rotary spring 830 is formed between the right fixing portion 853 and the right portion 750 of the stand 710. Accordingly, when the stand 710 is brought into contact with the floor, the stand 710 is always subject to an upward force by a recovering force of the rotary spring 830. However, the stand 710 is not rotated and is fixed by friction generated in response to the friction protrusion 730 being brought into contact with a wheel 811.

In order to release the stand 710 from the fixing position, the user pushes the cleaner forward. Then, the wheel 811 is rotated and thus rotates the stand 710 connected with the friction protrusion 730, for example, in accordance with the rotation of wheel 811. Accordingly, the friction protrusion 730 and the stand 710 are separated from each other and the stand 710 is located adjacent to the upright supporter 200 by the recovering force of the rotary spring 830.

Figure 13C:
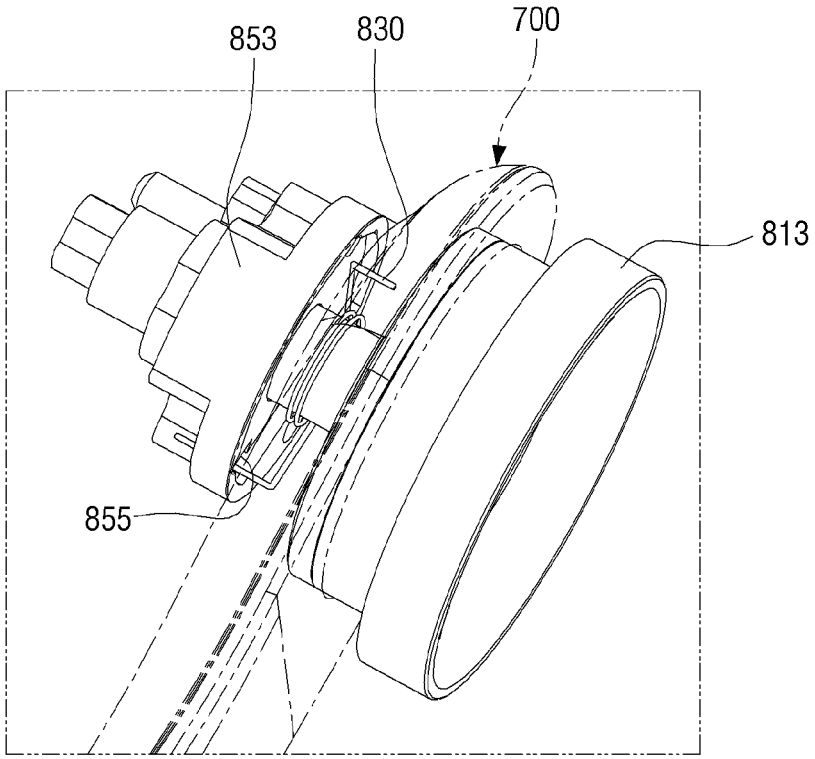
FIGS. 13C and 13D are enlarged views illustrating an elastic supporting structure of the stand of the standing structure shown in FIG. 12A.
Figure 13D:
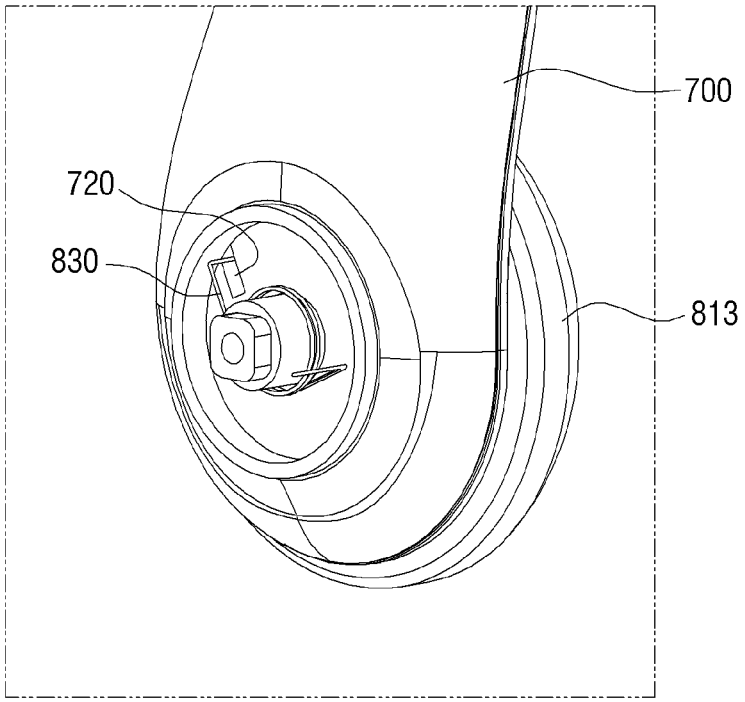

FIGS. 13C and 13D are enlarged views of the rotary spring 830 which indicates an exemplary elastic supporting structure of the stand of the standing structure.

The rotary spring 830 has one end supportedly connected with the first rotary spring connection recess 720 formed on the right portion 750 of the kick-stand portion 700, and the other end supportedly connected with a second rotary spring connection recess 855 formed on one side of the right fixing portion 853.

In response to the stand 710 being pulled downward, the stand 710 tends to move up by the elastic force generated as the rotary spring 830 is compressed. In addition, in response to the stand 710 being erected adjacent to the upright supporter 200, the recovering force is not exerted to the rotary spring 830.

In response to the stand 710 being located within a 90 degree angle from the floor surface, a predetermined recovering force is exerted to the rotary spring 830.

Figure 14A:
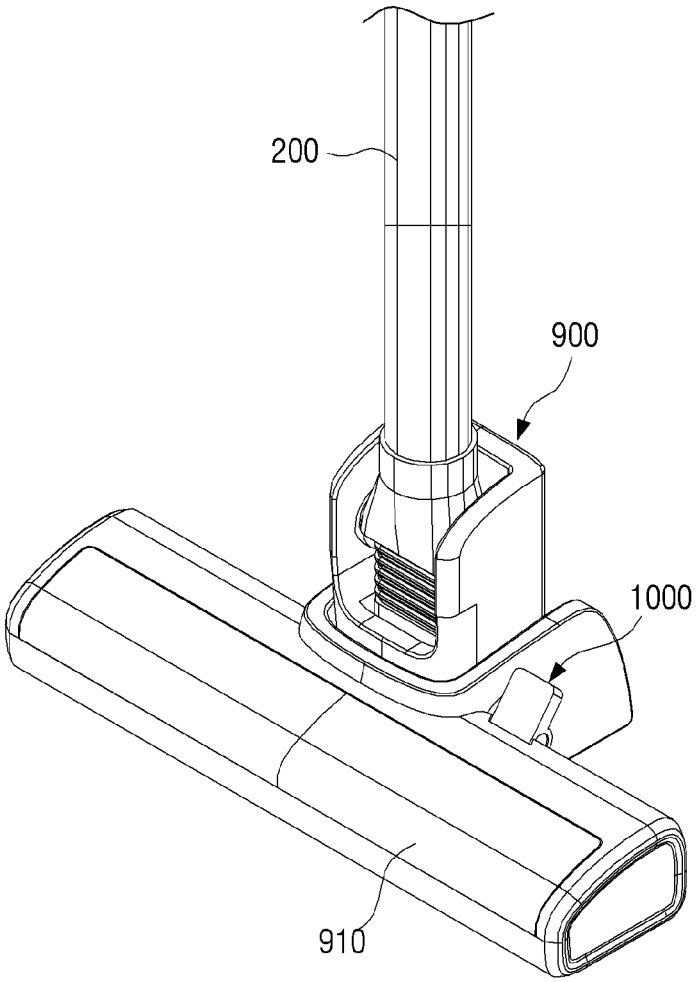
FIGS. 14A and 14B are perspective views illustrating an operation of another standing structure applied to a stick type vacuum cleaner according to an exemplary embodiment.
Figure 14B:
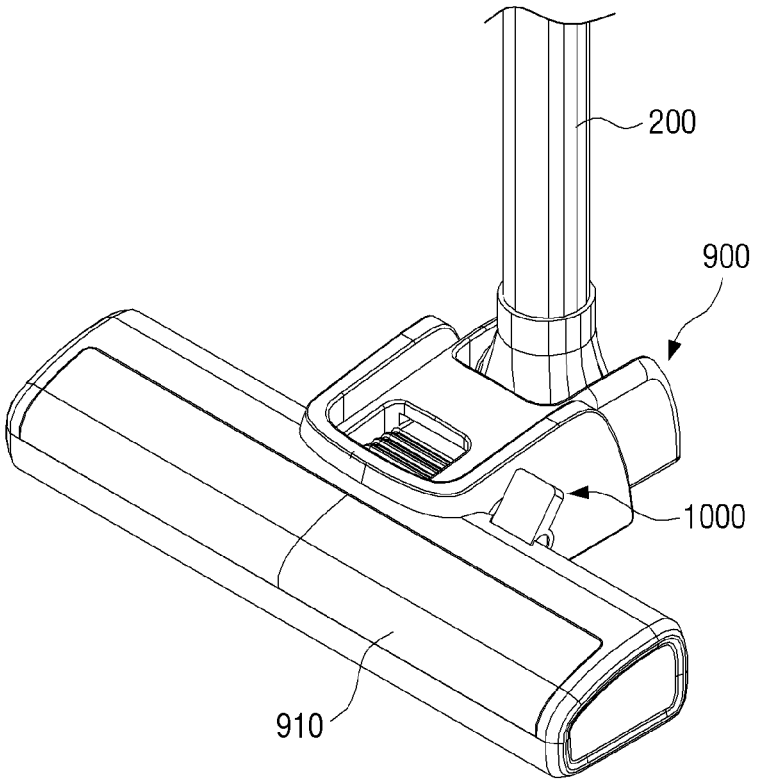

FIGS. 14A and 14B are views showing a self-standing structure which is applied to a stick type vacuum cleaner according to an exemplary embodiment.

Like the kick-standing structure, the user may need to erect the cleaner to mount an accessory in the middle of cleaning a wide area with the cleaner shown in FIG. 14A. When the cleaner is erected by self-standing as shown in FIG. 14B, the user can easily connect the accessory.

Figure 15:
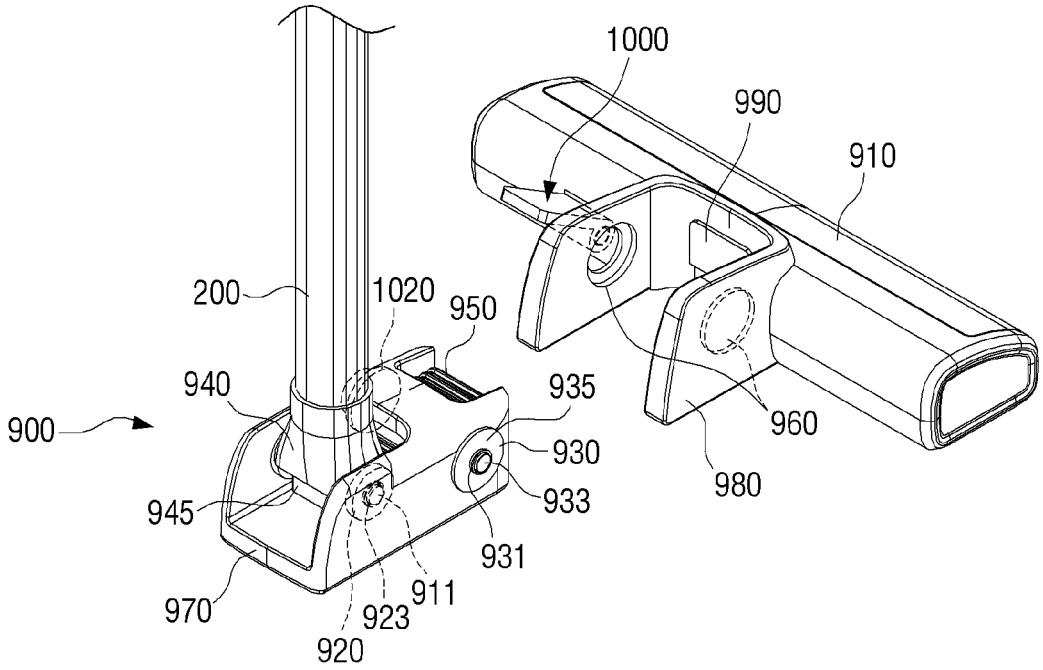
FIG. 15 is an exploded perspective view illustrating the standing structure shown in FIG. 14A.

Referring to FIG. 15, the self-standing structure includes a self-stand portion 900 and a lever portion 1000.

The self-stand portion 900 includes a first hinge connection portion 920, a second hinge connection portion 930, a bending connection portion 940, an articulated channel portion 950, a hinge support recess 960, a bending connection portion fixing portion 945, a first housing 970, a second housing 980, and a suction nozzle connection pipe 990.

The first hinge connection portion 920 supports the bending connection portion 940 and a supporter 200 is connected with the bending connection portion 940. A rotary spring 923 is provided on opposite side surfaces of the first hinge connection portion 920 to prevent the supporter 200 from being rotated to a suction nozzle 910 when a cleaning operation is performed as shown in FIG. 14A.

The second hinge connection portion 930 is formed adjacent to the suction nozzle 910 to connect the first housing 970 and the second housing 980.

In this case, the first housing 970 is rotated about the second housing 980 by the hinge support recess 960 formed on opposite sides of the second housing 980.

In addition, the second hinge connection portion 930 may further include a rotary spring 931. In this case, when the cleaning operation is performed as shown in FIG. 14A, the articulated channel portion 950 is not bent opposite to the suction nozzle 910 and is maintained in parallel with the supporter 200.

A fixing pin 933 fixedly connects the first housing 970 and a first rotary ring 935, and the first rotary ring 935 may be rotated about the hinge support recess 960 along with the first housing 970.

A second rotary ring 1020 is disposed on the hinge support recess 960 to be connected with the lever portion 1000. The second rotary ring 1020 is thicker than the first rotary ring 935 to be connected with the lever portion 1000, and protrudes toward the lever portion 1000.

The bending connection portion 940 connects a lower portion of the supporter 200 and the articulated channel portion 950, and may be made of rubber material having elasticity. Referring to FIG. 15, the bending connection portion fixing portion 945 is formed under the bending connection portion 940 and on the first housing 970 to maintain the supporter 200 in an upright position with respect to the first housing 970.

The articulated channel portion 950 connects the bending connection portion 940 and the suction nozzle connection pipe 990. In addition, the articulated channel portion 950 is stretchable in a lengthwise direction and is elastically bendable, such that the articulated channel portion 950 can be elastically fixed to the suction nozzle connection pipe 990 even when the cleaner is in an upright position or in a cleaning position, and thus, air including dirt does no leak and can be directly moved to a suction channel portion (not shown) of the supporter 200.

The first housing 970 may accommodate the first and second hinge connection portions 920 and 930, the bending connection portion 940, and the articulated channel portion 950.

The second housing 980 may accommodate the hinge support recess 960, and the first housing 970 is connected with the second housing 980 by the second hinge connection portion 920.

Figure 16A:
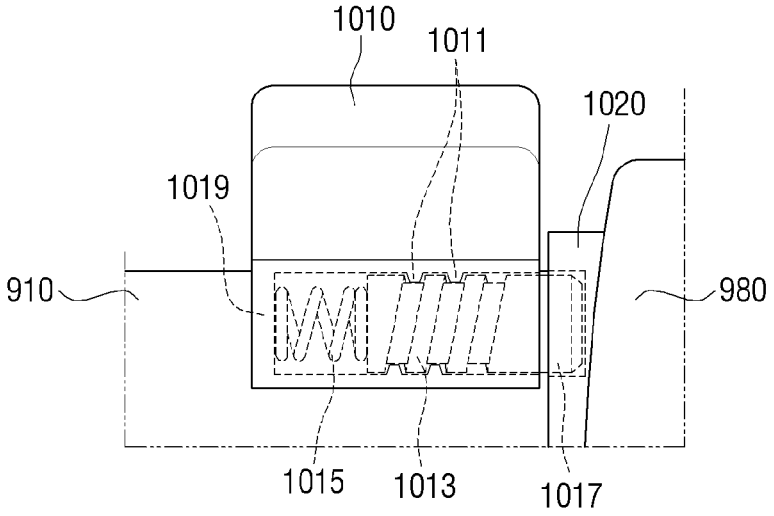
FIGS. 16A and 16B are schematic views illustrating an operation of a lever shown in FIG. 15.
Figure 16B:
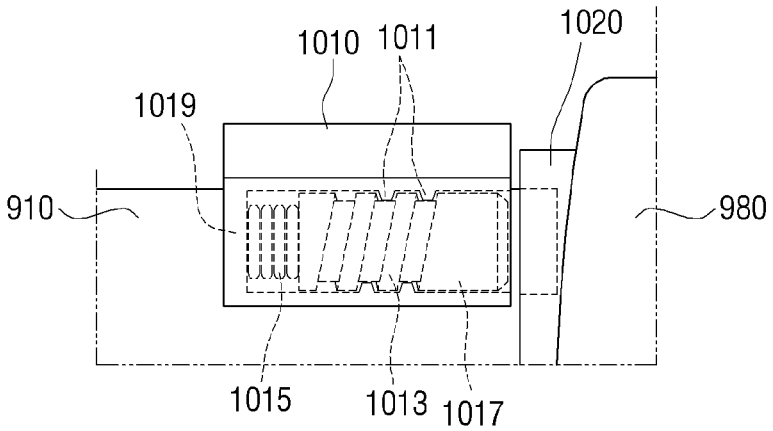

FIGS. 16A and 16B are views showing a configuration and an operation of the lever portion 1000.

Referring to FIGS. 16A and 16B, the lever portion 1000 is fixed to the suction nozzle 910, and includes a lever 1010, a guide protrusion 1011, a spiral rail portion 1013, an axial direction spring 1015, a fixing protrusion 1017, a spring supporter 1019, and a second rotary ring 1020.

As shown in FIG. 16A, in response to the lever 1010 being rotated upward with reference to a center of a height of the lever portion 1000, the fixing protrusion 1017 formed at one end of the spiral rail portion 1013 is moved toward the second housing 980 by the guide protrusion 1011.

In response the lever 1010 being rotated downward with reference to the center of the height of the lever portion 1000 as shown in FIG. 16B, the fixing protrusion 1017 formed at one end of the spiral rail portion 1013 is moved in the opposite direction of the second housing 980 by the guide protrusion 1011. The lever 1010 may be pivoted up and down by using user's foot.

A least two guide protrusions 1011 are provided right under the lever 1010 and are connected with a rail of the spiral rail portion 1013. The axial direction spring 1015 is located between the spiral rail portion 1013 and the spring supporter 1019, and always elastically supports the spiral rail portion 1013 toward the second housing 980. The fixing protrusion 1017 is connected with the spiral rail portion 1013 and is configured to be connected with or disconnected from a guide fixing recess 1021 or a circular fixing recess 1023 of the second rotary ring 1020

Figure 17A:
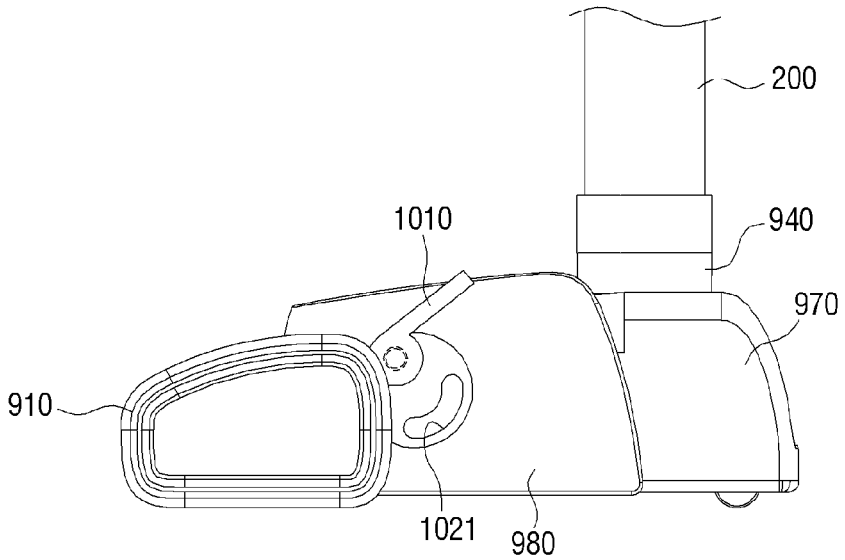
FIG. 17A to 17C are schematic views illustrating an operation of a standing structure shown in FIGS. 14A and 14B in sequence.
Figure 17B:
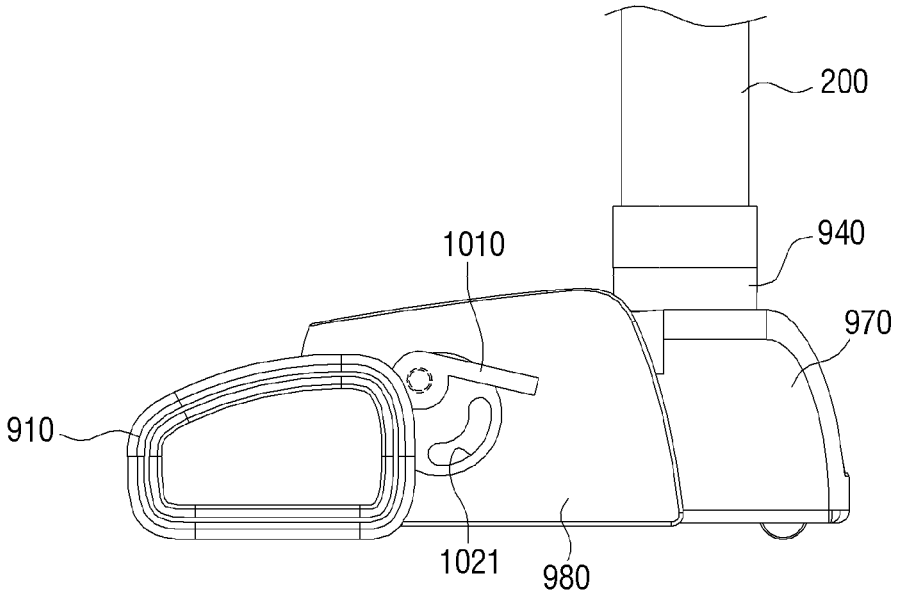
Figure 17C:
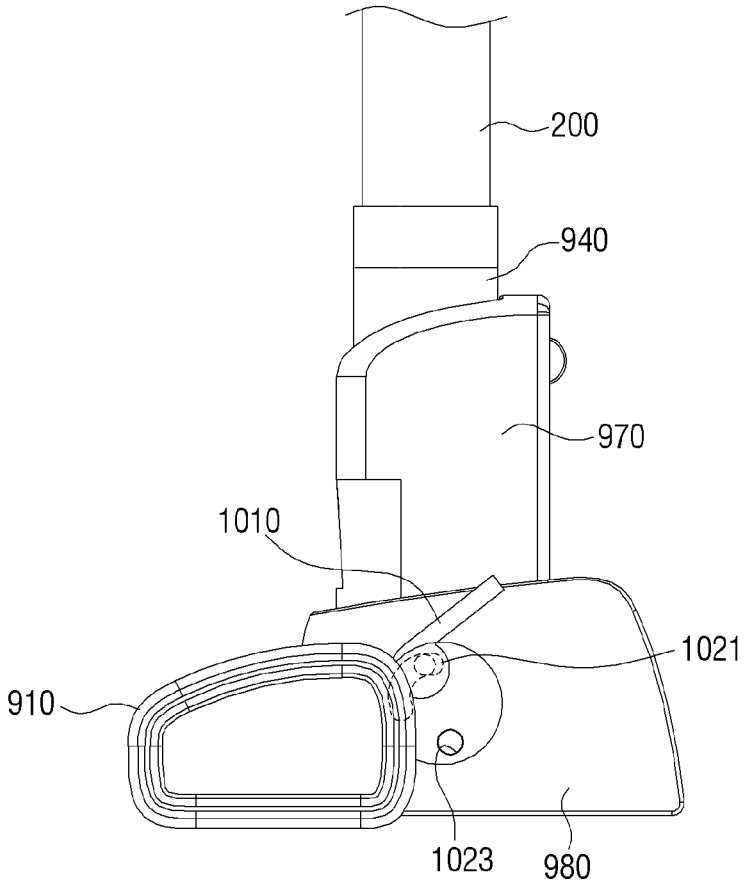

FIGS. 17A to 17C are views showing an interworking operation of the self-stand portion 900 and the lever portion 1000.

Referring to FIGS. 16A to 17C, in response to the lever 1010 being moved up, the fixing protrusion 1017 is inserted into the circular fixing recess 1023 formed on the second rotary ring 1020. Accordingly, the first housing 970 connected with the second housing 980 is fixed to the lever portion 1000 by the fixing protrusion 1017, and the bending connection portion 940 is supported by the bending connection portion fixing portion 945 formed at the lower end of the bending connection portion 940. In this manner, the self-standing is implemented. In this state, the user can easily connect the accessory to the vacuum cleaning unit.

In response to the lever 1010 being moved down by user's foot, the fixing protrusion 1017 is released from the circular fixing recess 1023. Accordingly, the first housing 970 is freely rotated with respect to the second housing 980, and thus, the supporter 200 can be lifted up as shown in FIG. 17C.

Referring to FIG. 17C, the first housing 970 is erected with respect to the second housing 980, and in response to the lever 1010 being moved up, the fixing protrusion 1017 is inserted into the guide fixing recess 1021. Accordingly, the first housing 970 cannot be rotated in a counter-clockwise direction, that is, to the suction nozzle 910, according to the shape of the guide fixing recess 1021, but can be rotated in a clockwise direction. The user can easily perform the cleaning operation by rotating the supporter 200 by a predetermined angle.

The supporter 200 is restricted from being rotated in a counter clockwise direction with respect to the first hinge portion 920, that is, to the suction nozzle 910, by the rotary spring 923 disposed on the first hinge connection portion 920.

Users may need to place the cleaner in an upright position for a while to clean a narrow area, such as a crack in the middle of cleaning a wide area or to clean a wire area in the middle of cleaning a narrow area. In this case, if the user lays down the cleaner or lays the cleaner against a wall to connect a part such as an accessory, the user may experience inconvenience and it takes much time. The standing structure including the kick-standing and self-standing structures explained with reference to FIGS. 12A to 17C enables the user to place the cleaner in the upright position rapidly and stably when the user wishes to change a cleaning area. Therefore, the exemplary embodiments described with reference to FIGS. 1A to 11 can be easily implemented.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A supporter comprising:

a suction channel portion that comprises one end removably connected with a vacuum cleaning unit and the other end connected with a suction nozzle, thereby guiding dirt drawn in through the suction nozzle to the vacuum cleaning unit;

an accessory that is received in a receiving recess formed on one side of the suction channel portion;

a hinge portion that is disposed in the suction channel portion and supports the accessory to pivot by a predetermined angle; and an unlocking portion that is disposed in the suction channel portion to lock and unlock the accessory with respect to the receiving recess.

2. The supporter of claim 1, wherein the hinge portion is disposed in the receiving recess, and comprises one end connected with the suction channel portion by a hinge and the other end removably inserted into a lower end of the accessory.

3. The supporter of claim 2, wherein the unlocking portion comprises:

an operating button having a part exposed to an outside of the suction channel portion; and an elastic member configured to elastically support the operating button.

4. The supporter of claim 3, wherein the operating button comprises a connection protrusion removably connected with an upper portion of the accessory, and the accessory comprises an insertion recess formed at a location to correspond to the connection protrusion when the accessory is inserted into the receiving recess.

5. The supporter of claim 4, wherein a center of gravity of the accessory is located at an upper end portion of the accessory at an eccentric location that is in a direction of the accessory being separated from the receiving recess.

6. The supporter of claim 4, wherein the accessory is received in the receiving recess slantly in a direction of being separated from the receiving recess.

7. The supporter of claim 4, wherein the hinge portion is elastically disposed in the suction channel portion so that the accessory is pivoted in a direction towards an outside of the receiving recess.

8. The supporter of claim 3, further comprising:

a first magnet that is disposed in the suction channel portion; and a second magnet that is disposed in the accessory and has a same polarity as that of the first magnet, and wherein the first and second magnets are disposed at locations facing each other when the accessory is inserted into the receiving recess.

9. The supporter of claim 3, wherein the unlocking portion comprises:

an operating rod that interacts with the operating button;

a third magnet that is disposed in the suction channel portion; and a fourth magnet that is disposed in the accessory and has a polarity opposite to that of the third magnet, and wherein the operating rod comprises a connection protrusion formed at one end thereof to be removably connected with an upper end of the accessory.

10. The supporter of claim 9, wherein the other end of the operating rod is connected with the suction channel portion by a hinge.

11. The supporter of claim 2, wherein the unlocking portion makes the hinge portion pivot to the outside of the receiving recess in response to the vacuum cleaning unit being separated from the suction channel portion.

12. The supporter of claim 11, wherein the unlocking portion comprises:

a moving member that is inserted into the suction channel portion to ascend and descend in a lengthwise direction of the suction channel portion; and an elastic member that elastically supports the moving member in an ascending direction, and wherein the moving member is pressed by self-weight of the vacuum cleaning unit and is kept in a descending state, and, in response to the vacuum cleaning unit being separated from the suction channel portion, the moving member ascends by the elastic member.

13. The supporter of claim 12, wherein the hinge portion moves the accessory to be drawn out from the receiving recess or received in the receiving recess based on the ascending or descending movement of the moving member.

14. The supporter of claim 13, wherein the hinge portion comprises a locking protrusion, wherein the moving member comprises first and second push protrusion formed at locations corresponding to the hinge portion, and wherein the first and second push protrusions are formed at intervals in a lengthwise direction along the moving member, and push the locking protrusion of the hinge portion according to an ascending or descending movement of the moving member and pivot the hinge portion in one direction or in a reverse direction.

15. The supporter of claim 12, wherein the moving member comprises a locking protrusion for locking and unlocking the upper end of the accessory from the receiving recess.

16. The supporter of claim 15, wherein a center of gravity of the accessory is located at an upper end portion of the accessory at an eccentric location that is in a direction of the accessory being separated from the receiving recess.

17. The supporter of claim 16, wherein the accessory is received in the receiving recess slantly in a direction of being separated from the receiving recess.

18. The supporter of claim 15, further comprising:

a first magnet that is disposed in the suction channel portion; and a second magnet that is disposed in the accessory and has a same polarity as that of the first magnet, and wherein the first and second magnets are disposed at locations facing each other when the accessory is inserted into the receiving recess.

19. The supporter of claim 15, wherein the hinge portion is elastically disposed in the suction channel portion so that the accessory is pivoted in a direction towards the outside of the receiving recess.

20. The supporter of claim 1, wherein the receiving recess comprises a restriction projection extending from a lower end thereof to restrict a rotation angle of the accessory.

* * * * *